US009132659B2

(12) United States Patent
Ukishima et al.

(10) Patent No.: US 9,132,659 B2
(45) Date of Patent: Sep. 15, 2015

(54) IMAGE RECORDING APPARATUS, CONTROL METHOD THEREOF, AND RECORDING MEDIUM

(71) Applicant: FUJIFILM Corporation, Tokyo (JP)

(72) Inventors: Masayuki Ukishima, Kanagawa (JP); Masashi Ueshima, Kanagawa (JP)

(73) Assignee: FUJIFILM Corporation, Tokyo (JP)

( * ) Notice: Subject to any disclaimer, the term of this patent is extended or adjusted under 35 U.S.C. 154(b) by 0 days.

(21) Appl. No.: 14/254,353

(22) Filed: Apr. 16, 2014

(65) Prior Publication Data

US 2014/0313255 A1 Oct. 23, 2014

(30) Foreign Application Priority Data

Apr. 17, 2013 (JP) ..... 2013-086799

(51) Int. Cl.

| | |
|---|---|
| ***B41J 29/38*** | (2006.01) |
| ***B41J 2/21*** | (2006.01) |
| *B41J 29/393* | (2006.01) |
| *B41J 25/00* | (2006.01) |

(52) U.S. Cl.

CPC ..... *B41J 2/2142* (2013.01); *B41J 2/2139* (2013.01); *B41J 2025/008* (2013.01); *B41J 2029/3935* (2013.01)

(58) Field of Classification Search

CPC ..... B41J 2025/008; B41J 2029/3935; B41J 2/2139; B41J 2/2142

USPC ..... 347/10, 19, 14

See application file for complete search history.

(56) References Cited

U.S. PATENT DOCUMENTS

| | | | | |
|---|---|---|---|---|
| 5,353,052 | A | 10/1994 | Suzuki et al. | |
| 2009/0244150 | A1 * | 10/2009 | Inoue et al. | 347/14 |
| 2010/0207983 | A1 | 8/2010 | Sasayama | |
| 2011/0084996 | A1 * | 4/2011 | Hirato et al. | 347/10 |
| 2012/0050377 | A1 * | 3/2012 | Ueshima | 347/19 |

FOREIGN PATENT DOCUMENTS

| | | | |
|---|---|---|---|
| JP | H04-028550 | A | 1/1992 |
| JP | 2010-082989 | A | 4/2010 |
| JP | 2010-083007 | A | 4/2010 |
| JP | 2010-188663 | A | 9/2010 |
| JP | 2012-071474 | A | 4/2012 |

OTHER PUBLICATIONS

An Office Action; "Notification of Reasons for Rejection," issued by the Japanese Patent Office on Jun. 5, 2015, which corresponds to Japanese Patent Application No. 2013-086799 and is related to U.S. Appl. No. 14/254,353; with English language partial translation.

* cited by examiner

*Primary Examiner* — Julian Huffman
*Assistant Examiner* — Carlos A Martinez
(74) *Attorney, Agent, or Firm* — Studebaker & Brackett PC

(57) ABSTRACT

Unevenness correcting information is generated based on property information indicating a recording property of each of a plurality of recording elements which are included in a recording head, the recording elements being subjected to output correction in a first output correction unit based on unevenness correcting information obtained after a flattening processing and output correction in a second output correction unit, and the unevenness correcting information close to an appropriate value with which an image in an appropriately-corrected state can be obtained can be generated.

11 Claims, 20 Drawing Sheets

IMAGE RECORDING APPARATUS, CONTROL METHOD THEREOF, AND RECORDING MEDIUM

BACKGROUND OF THE INVENTION

1. Field of the Invention

The presently disclosed subject matter relates to an image recording apparatus which corrects density unevenness in an image, and a control method and a program thereof.

2. Description of the Related Art

There has been known an ink-jet recording apparatus (an image recording apparatus) which forms an image on a recording medium by ejecting ink from a plurality of ink-ejecting nozzles (simply referred to as a nozzle below) provided on an ink-jet head. In the ink-jet recording apparatus, density unevenness may occur in the recorded image due to variations in ejection properties (recording properties) of the respective nozzles of the ink-jet head. Thus, an ink-jet recording apparatus according to Japanese Patent Application Laid-Open No. 2010-082989 performs so-called density unevenness correction in which a correction value for the output density of each nozzle (a look-up table or the like) is obtained based on the ejection property of each nozzle obtained by outputting and analyzing a density correcting test chart, and ink ejection from each nozzle is controlled based on an image signal corrected according to the correction value.

In an ink-jet recording apparatus, there is generated a non-ejection nozzle which cannot eject ink due to clogging or breakdown over time. When the non-ejection nozzle as described above is generated, stripe unevenness (a white stripe or a white-black stripe) caused by the non-ejection nozzle occurs in a single-pass-type ink-jet recording apparatus when a recorded image is observed. Thus, an ink-jet recording apparatus according to Japanese Patent Application Laid-Open No. 2012-071474 performs so-called non-ejection correction in which ink ejection from a defective nozzle is prohibited, and the output densities of adjacent nozzles adjacent to the defective nozzle are increased.

The stripe unevenness is caused not only by the non-ejection nozzle described above, but also by a "largely-deflected nozzle" having a large amount of ink flight deflection. As a first correction method for correcting the stripe unevenness caused by the largely-deflected nozzle, a method for performing the density unevenness correction described in Japanese Patent Application Laid-Open No. 2010-082989 in a state in which ink ejection from the largely-deflected nozzle is continued is employed. As a second correction method, a method for performing the non-ejection correction described in Japanese Patent Application Laid-Open No. 2012-071474 in which the output densities of adjacent nozzles adjacent to the largely-deflected nozzle are increased. However, in an ink-jet recording apparatus in which the density unevenness correction and the non-ejection correction are both employed, overlapping correction (also referred to as overcorrection) may occur when the density unevenness correction and the non-ejection correction are applied in an overlapping manner.

In an ink-jet recording apparatus according to Japanese Patent Application Laid-Open No. 2010-188663, when a defective nozzle such as a largely-deflected nozzle is generated, a correction value for correcting density unevenness is modified by changing density measurement values of the defective nozzle and adjacent nozzles by use of density measurement values of surrounding nozzles that are not affected by the defective nozzle. Subsequently, the ink-jet recording apparatus executes density unevenness correction based on the modified correction value, and non-ejection correction.

That is, in the method according to Japanese Patent Application Laid-Open No. 2010-188663, the priority of the density unevenness correction is decreased, and the priority of the non-ejection correction is increased.

SUMMARY OF THE INVENTION

However, there is still a possibility that the overlapping correction is performed even in the ink-jet recording apparatus according to Japanese Patent Application Laid-Open No. 2010-188663. To be more specific, there is no problem when the largely-deflected nozzle was a normal nozzle at the time of previously generating the correction value. However, when the nozzle was normal enough not to be detected as a defective nozzle, or when a detecting process was failed, the density unevenness correction may already have been applied to the output of the nozzle. When the non-ejection correction is performed on the largely-deflected nozzle in the above state, the overlapping correction is performed to cause stripe unevenness (referred to as overlapping overcorrection stripe unevenness below) in a recorded image. The overlapping overcorrection stripe unevenness can be corrected by repeatedly updating the correction value for correcting density unevenness. In this case, however, the correction value is updated from a state in which the correction value is away from an appropriate value that enables appropriate correction of an image. Thus, the update number of times until an appropriate correction value is obtained is increased to require a longer time and a higher cost.

Also, in the ink-jet recording apparatus according to Japanese Patent Application Laid-Open No. 2010-188663, the density measurement values of the defective nozzle and the adjacent nozzles are changed by use of the density measurement values of the surrounding nozzles. However, when the density measurement values of the surrounding nozzles themselves are obtained as a result of performing the density unevenness correction, the overlapping overcorrection stripe unevenness may occur. The overlapping overcorrection stripe unevenness can also be corrected by repeatedly updating the correction value for correcting density unevenness in this case. However, a longer time and a higher cost are required as described above.

An object of the presently disclosed subject matter is to provide an image recording apparatus which can obtain an appropriate correction value for correcting density unevenness (unevenness correcting information) with a small update number of times while preventing overlapping correction of density unevenness correction and non-ejection correction, and a control method and a program thereof.

To achieve the object of the presently disclosed subject matter, an image recording apparatus includes: a recording control unit which records an image on a recording medium by a recording head having a plurality of recording elements while relatively moving the recording head and the recording medium; a first storage unit which preliminarily stores unevenness correcting information indicating a correction value of an output for each of the recording elements for correcting unevenness in the image; a defective recording element detection unit which detects a defective recording element out of the respective recording elements and stores defective recording element information indicating the defective recording element in a second storage unit; a defective recording element information acquisition unit which acquires the defective recording element information at a previous timing of updating the unevenness correcting information and the latest defective recording element information from the second storage unit when a timing of updating the unevenness correcting information arrives; a flattening processing unit which compares the previous and latest defective recording element information acquired by the defective recording element information acquisition unit, and when a new defective recording element is detected in the latest defective recording element information, performs flattening processing to suppress variations in the correction values corresponding to a plurality of surrounding recording elements located around the defective recording element on the unevenness correcting information read out from the first storage unit; a first output correction unit which corrects outputs of the respective recording elements based on the unevenness correcting information obtained after the flattening processing when the flattening processing is performed by the flattening processing unit; a second output correction unit which suspends an output of the defective recording element and increases an output of a recording element at least adjacent to the defective recording element after the correction by the first output correction unit; a property information acquisition unit which acquires property information indicating a recording property of each of the recording elements, the outputs of which are corrected by the first and second output correction units; and an unevenness correcting information generation unit which generates new unevenness correcting information corresponding to the property information acquired by the property information acquisition unit, and updates the unevenness correcting information in the first storage unit.

In accordance with the presently disclosed subject matter, the unevenness correcting information is generated based on the recording property of each of the recording elements subjected to the output correction in the first output correction unit based on the unevenness correcting information obtained after the flattening processing and the output correction in the second output correction unit. Thus, the unevenness correcting information close to an appropriate value with which an image in an appropriately-corrected state can be obtained can be generated.

The flattening processing unit may perform processing to suppress an amplitude of the variation in the correction value corresponding to each of the surrounding recording elements as the flattening processing. Accordingly, the variations in the correction values corresponding to the surrounding recording elements can be suppressed.

Based on the correction values corresponding to surrounding recording elements located at both ends of an arrangement direction of the recording elements out of the respective surrounding recording elements, the flattening processing unit may perform processing to determine the correction value corresponding to another surrounding recording element by linear interpolation processing as the flattening processing. Accordingly, the variations in the correction values corresponding to the surrounding recording elements can be suppressed.

The flattening processing unit may perform smoothing processing on the correction values corresponding to the respective surrounding recording elements as the flattening processing. Accordingly, the variations in the correction values corresponding to the surrounding recording elements can be suppressed.

The surrounding recording elements may be the recording elements located in a range wider than a range of the recording element, the output of which is increased by the second output correction unit. Accordingly, overlapping correction by the first and second output correction units can be prevented.

The image recording apparatus may further include a repetition control unit which repeatedly operates the flattening processing unit, the first output correction unit, the second output correction unit, the property information acquisition unit, and the unevenness correcting information generation unit every time the timing of updating the unevenness correcting information arrives. Accordingly, the unevenness correcting information can be brought closer to the appropriate value.

The property information acquisition unit may read a test chart recorded on the recording medium by the respective recording elements, the outputs of which are corrected by the first and second output correction units, and indicating recording densities of the respective recording elements, and acquire a reading result of the test chart as property information.

When the flattening processing unit is not operated, the first output correction unit may correct the outputs of the respective recording elements based on the unevenness correcting information in the first storage unit. Accordingly, the unevenness in the image can be corrected by using the unevenness correcting information close to the appropriate value except at the timing of updating the unevenness correcting information.

The recording head may be an ink-jet head.

To achieve the object of the presently disclosed subject matter, a method for controlling an image recording apparatus includes: a storage step of preliminarily storing, in a first storage unit, unevenness correcting information indicating a correction value of an output for each of a plurality of recording elements of a recording head for correcting unevenness in an image recorded on a recording medium by the recording head; a defective recording element detection step of detecting a defective recording element out of the respective recording elements and storing defective recording element information indicating the defective recording element in a second storage unit; a defective recording element information acquisition step of acquiring the defective recording element information at a previous timing of updating the unevenness correcting information and the latest defective recording element information from the second storage unit when a timing of updating the unevenness correcting information arrives; a flattening processing step of comparing the previous and latest defective recording element information acquired in the defective recording element information acquisition step, and when a new defective recording element is detected in the latest defective recording element information, performing flattening processing to suppress variations in the correction values corresponding to a plurality of surrounding recording elements located around the defective recording element on the unevenness correcting information read out from the first storage unit; a first output correction step of correcting outputs of the respective recording elements based on the unevenness correcting information subjected to the flattening processing in the flattening processing step; a second output correction step of suspending an output of the defective recording element and increasing an output of another recording element at least adjacent to the defective recording element after the correction in the first output correction step; a property information acquisition step of acquiring property information indicating a recording property of each of the recording elements, the outputs of which are corrected in the first and second output correction steps; and an unevenness correcting information generation step of generating new unevenness correcting information corresponding to the property information acquired in the property information acquisition step, and updating the unevenness correcting information in the first storage unit. The method may further include a step of recording a test chart indicating recording densities of the respective recording elements by the respective recording elements, the outputs of which are corrected in the first and second output correction steps, wherein a reading result of the test chart may be acquired as property information in the property information acquisition step.

To achieve the object of the presently disclosed subject matter, a program causes a computer to execute: a storage step of preliminarily storing, in a first storage unit, unevenness correcting information indicating a correction value of an output for each of a plurality of recording elements of a recording head for correcting unevenness in an image recorded on a recording medium by the recording head; a defective recording element detection step of detecting a defective recording element out of the respective recording elements and storing defective recording element information indicating the defective recording element in a second storage unit; a defective recording element information acquisition step of acquiring the defective recording element information at a previous timing of updating the unevenness correcting information and the latest defective recording element information from the second storage unit when a timing of updating the unevenness correcting information arrives; a flattening processing step of comparing the previous and latest defective recording element information acquired in the defective recording element information acquisition step, and when a new defective recording element is detected in the latest defective recording element information, performing flattening processing to suppress variations in the correction values corresponding to a plurality of surrounding recording elements located around the defective recording element on the unevenness correcting information read out from the first storage unit; a first output correction step of correcting outputs of the respective recording elements based on the unevenness correcting information subjected to the flattening processing in the flattening processing step; a second output correction step of suspending an output of the defective recording element and increasing an output of another recording element at least adjacent to the defective recording element after the correction in the first output correction step; a property information acquisition step of acquiring property information indicating a recording property of each of the recording elements, the outputs of which are corrected in the first and second output correction steps; and an unevenness correcting information generation step of generating new unevenness correcting information corresponding to the property information acquired in the property information acquisition step, and updating the unevenness correcting information in the first storage unit.

The image recording apparatus, and the control method and the program thereof according to the presently disclosed subject matter can obtain the unevenness correcting information having the appropriate value with a small update number of times while preventing the overlapping correction.

DETAILED DESCRIPTION OF THE EXEMPLARY EMBODIMENTS

Figure 1:
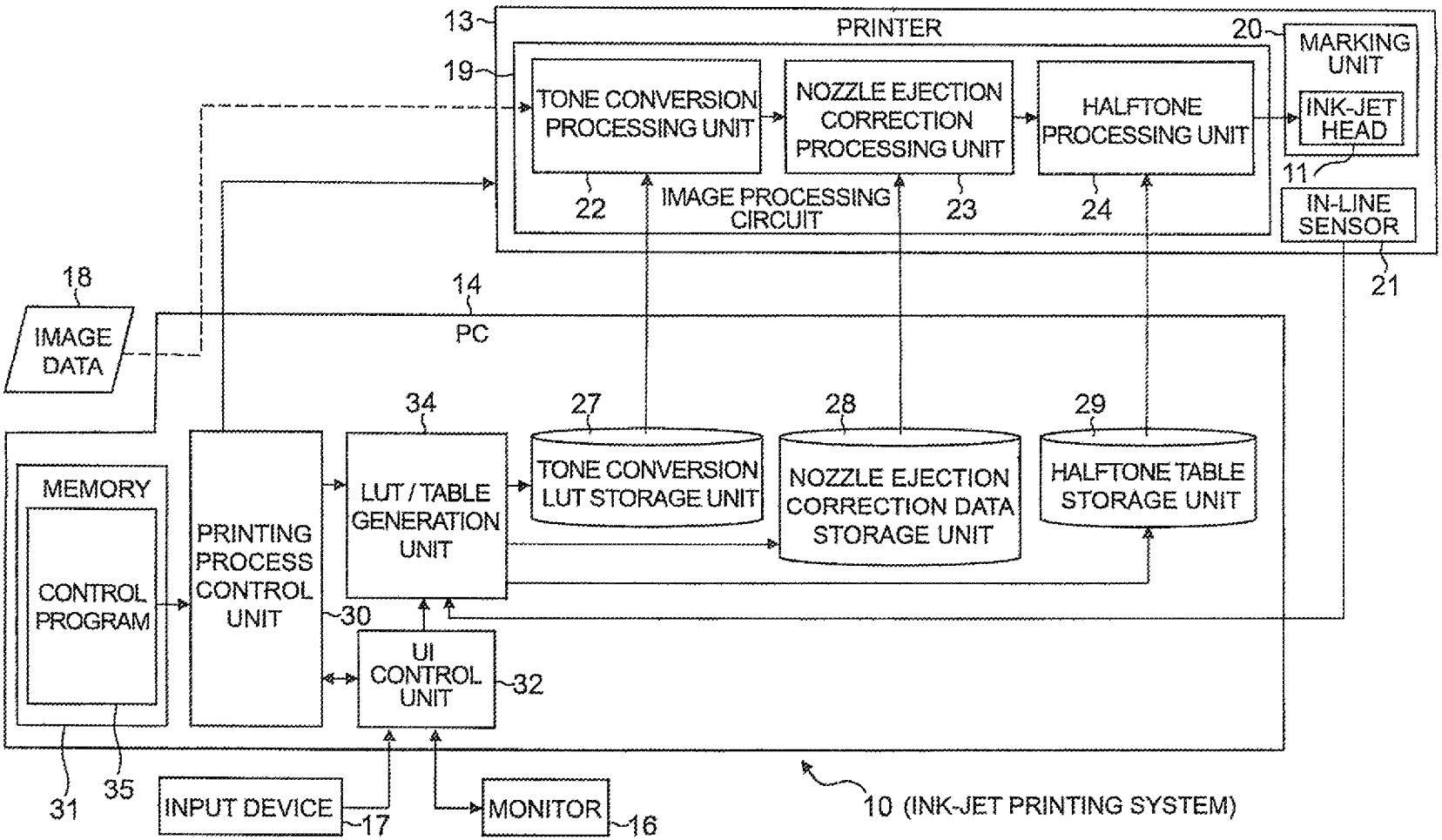
FIG. 1 is a schematic diagram of an ink-jet printing system.

As illustrated in FIG. 1, an ink-jet printing system (simply referred to as a printing system below) 10 corresponds to an image recording apparatus in the presently disclosed subject matter. The printing system 10 records an image in a single pass method by using an ink-jet head 11 (a recording head). That is, the printing system 10 records (also referred to as forms, prints, or draws) an image on an image recording region of a recording medium 12 at a predetermined recording resolution (e.g., 1,200 dpi) by performing an operation of relatively moving the recording medium 12 (see FIG. 3) with respect to the ink-jet head 11 only once. In the present embodiment, image recording is performed by using ink of four colors: cyan (C), magenta (M), yellow (Y), and black (K). However, a combination of the color of ink and the number of colors is not limited to that of the present embodiment.

The printing system 10 includes a printer 13, a computer body (represented as a "PC" below) 14, a monitor 16, an input device 17 or the like.

The printer 13 records an image on the recording medium 12 by using the ink-jet head 11 under control of the PC 14. The PC 14 functions as a control device which controls the operation of the printer 13, and also functions as a data management device which manages various data.

The monitor 16 and the input device 17 are connected to the PC 14, and function as a user interface of the PC 14. The monitor 16 displays an operation screen or the like of the printer 13 output from the PC 14. A keyboard, a mouse, a touch panel, a trackball or the like may be employed as the input device 17. A combination thereof may also be used. An operator operates the printer 13 by manipulating the input device 17 while looking at the operation screen or the like displayed on the monitor 16. When a print instruction is issued at the input device 17, image data 18 such as page data is transmitted to the printer 13 from the PC 14.

<Configuration of the Printer>

The printer 13 mainly includes an image processing circuit (an image processing board) 19, a marking unit (a recording control unit) 20, and an in-line sensor (a property information acquisition unit) 21. The image processing circuit 19 generates a marking signal by performing signal processing such as tone conversion processing, nozzle ejection correction processing, and halftone processing on the image data 18 input from the PC 14. The image processing circuit 19 includes a tone conversion processing unit 22, a nozzle ejection correction processing unit 23, a halftone processing unit 24 or the like.

The tone conversion processing unit 22 performs processing to determine the property of density tone, that is, to determine at which color density an image is drawn when the image is recorded by the marking unit 20 described below. The tone conversion processing unit 22 converts the image data 18 so as to obtain a coloring property defined in the printer 13. For example, the tone conversion processing unit 22 converts a CMYK signal of the image data 18 to a $C_1M_1Y_1K_1$ signal, or converts respective signals of a C signal, an M signal, a Y signal, and a K signal individually to a $C_1$ signal, an $M_1$ signal, a $Y_1$ signal, and a $K_1$ signal.

The tone conversion processing unit 22 determines a conversion relationship of the signal conversion (the tone conversion) based on a tone conversion look-up table (LUT) (not illustrated) stored in a tone conversion LUT storage unit 27 within the PC 14. A plurality of tone conversion LUTs respectively optimized according to the types of the recording media 12 are stored in the tone conversion LUT storage unit 27. An appropriate LUT according to the type of the recording medium 12 is automatically set in the tone conversion processing unit 22. The tone conversion LUTs are prepared for each color of ink.

The nozzle ejection correction processing unit 23 corrects the output density of each nozzle 11A (a recording element, see FIG. 6) of the ink-jet head 11 so as to correct unevenness in the image recorded on the recording medium 12 by the ink-jet head 11. The "output density" here corresponds to the output of the recording element in the presently disclosed subject matter, and the correction of the output density means correction of an ink ejection amount. The "unevenness in the image" here means density unevenness caused by variations in ejection properties (recording properties) of the respective nozzles 11A, or stripe unevenness caused by a defective nozzle $\mathbf{11}_{NG}$ (a defective recording element, see FIG. 7) such as a non-ejection nozzle and a largely-deflected nozzle. The nozzle ejection correction processing unit 23 corrects the output density of each nozzle 11A by performing signal conversion processing on an image signal input from the tone conversion processing unit 22 based on various correction LUTs in a nozzle ejection correction data storage unit 28 (a first storage unit) within the PC 14. The signal conversion processing by the nozzle ejection correction processing unit 23 is performed on each CMYK signal or on each of the signals with different colors similarly to the aforementioned tone conversion processing.

The halftone processing unit 24 performs halftone processing to convert, in a pixel unit, a multi-tone (e.g., 8 bits=256 tones per color) image signal to a binary signal indicative of whether or not to eject ink, or a multi-valued signal indicative of which type of droplet is ejected when an ink diameter (a droplet size) can be selected from a plurality of diameters (sizes). As the halftone processing, a dithering method, an error diffusion method, a density pattern method or the like may be applied. For example, the halftone processing unit 24 converts a multi-tone signal input from the nozzle ejection correction processing unit 23 to a four-valued marking signal of "eject large-droplet ink," "eject middle-droplet ink," "eject small-droplet ink," and "eject no ink." The signal conversion by the halftone processing unit 24 is executed based on a halftone table (not illustrated) stored in a halftone table storage unit 29 within the PC 14.

The marking unit 20 includes the ink-jet head 11 for each of the colors of CMYK, and a relative moving mechanism (e.g., each drum in FIG. 19) which relatively moves the ink-jet head 11 and the recording medium 12. The plurality of ink-ejecting nozzles 11A are arranged over a length corresponding to the maximum width of an image formation region of the recording medium 12 on an ink ejection surface (a nozzle surface) of each of the ink-jet heads 11.

Driving of the ink-jet head 11 is controlled by a head driver (not illustrated) based on a marking signal input from the halftone processing unit 24. That is, ink ejection from each of the nozzles 11A is controlled according to the four-valued signal. A large dot is recorded on the recording medium 12 by the large-droplet ink. A middle dot is recorded on the recording medium 12 by the middle-droplet ink. A small dot is recorded on the recording medium by the small-droplet ink. Accordingly, a multi-tone is recorded on the recording medium 12.

The in-line sensor 21 reads various test charts recorded on the recording medium 12 by the ink-jet head 11. For example, a CCD line sensor may be used as the in-line sensor 21. The ejection property (e.g., a recording density, a landing position error) of each of the nozzles 11A, and the defective nozzle $\mathbf{11}_{NG}$ can be detected based on the reading result (property information) of the test charts by the in-line sensor 21.

<Configuration of the PC>

The PC 14 includes a printing process control unit (a repetition control unit) 30, a memory 31, a user interface (UI) control unit 32, and an LUT/table generation unit 34 in addition to the aforementioned respective storage units 27 to 29. The respective units are configured by hardware or software of the PC 14, or a combination thereof.

The printing process control unit 30 controls the operations of the respective units of the printer 13 and the PC 14 by executing a control program (corresponding to a program in the presently disclosed subject matter) 35 read out from the memory 31. To be more specific, the printing process control unit 30 controls various processes in the LUT/table generation unit 34 or the like, and also performs display control of the monitor 16 and control in response to an input command from the input device 17 in cooperation with the UI control unit 32.

The printing process control unit 30 also issues a test chart record command and a test chart read command to the printer 13. Upon receiving the commands, the printer 13 records the test charts, reads the test charts using the in-line sensor 21, and outputs the reading result to the PC 14.

The LUT/table generation unit 34 generates various image processing parameters of the tone conversion LUT, the correction LUT, and the halftone table upon receiving a control signal from the printing process control unit 30 and a command signal from the UI control unit 32.

<Configuration of the LUT/Table Generation Unit>

Figure 2:
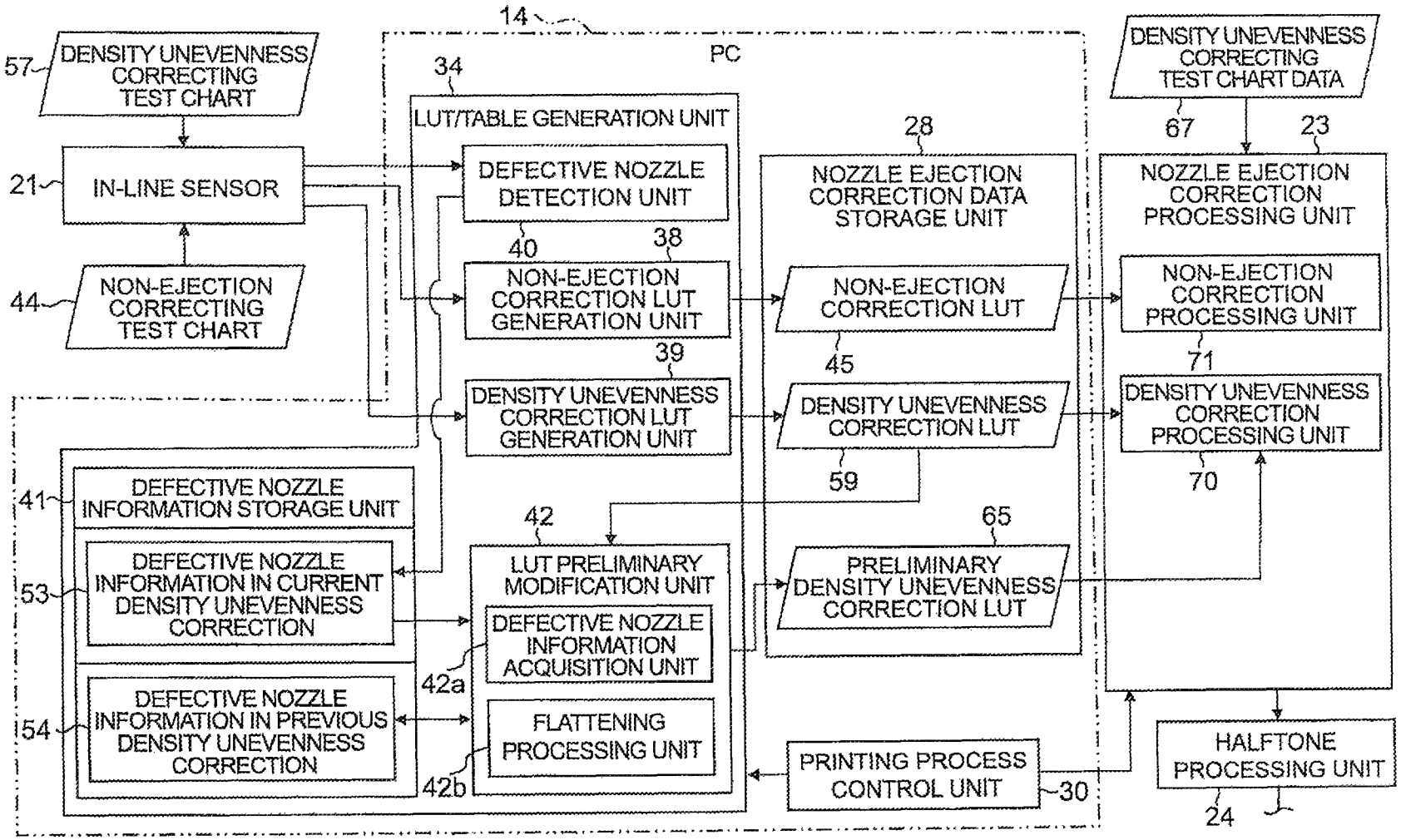
FIG. 2 is a function block diagram of an LUT/table generation unit.

As illustrated in FIG. 2, the LUT/table generation unit 34 functions as a non-ejection correction LUT generation unit 38, a density unevenness correction LUT generation unit (an unevenness correcting information generation unit) 39, a defective nozzle detection unit (a defective recording element detection unit) 40, a defective nozzle information storage unit 41, and an LUT preliminary modification unit 42 by executing the control program 35 upon receiving a command from the printing process control unit 30.

(Non-Ejection Correction LUT Generating Process)

Figure 3:
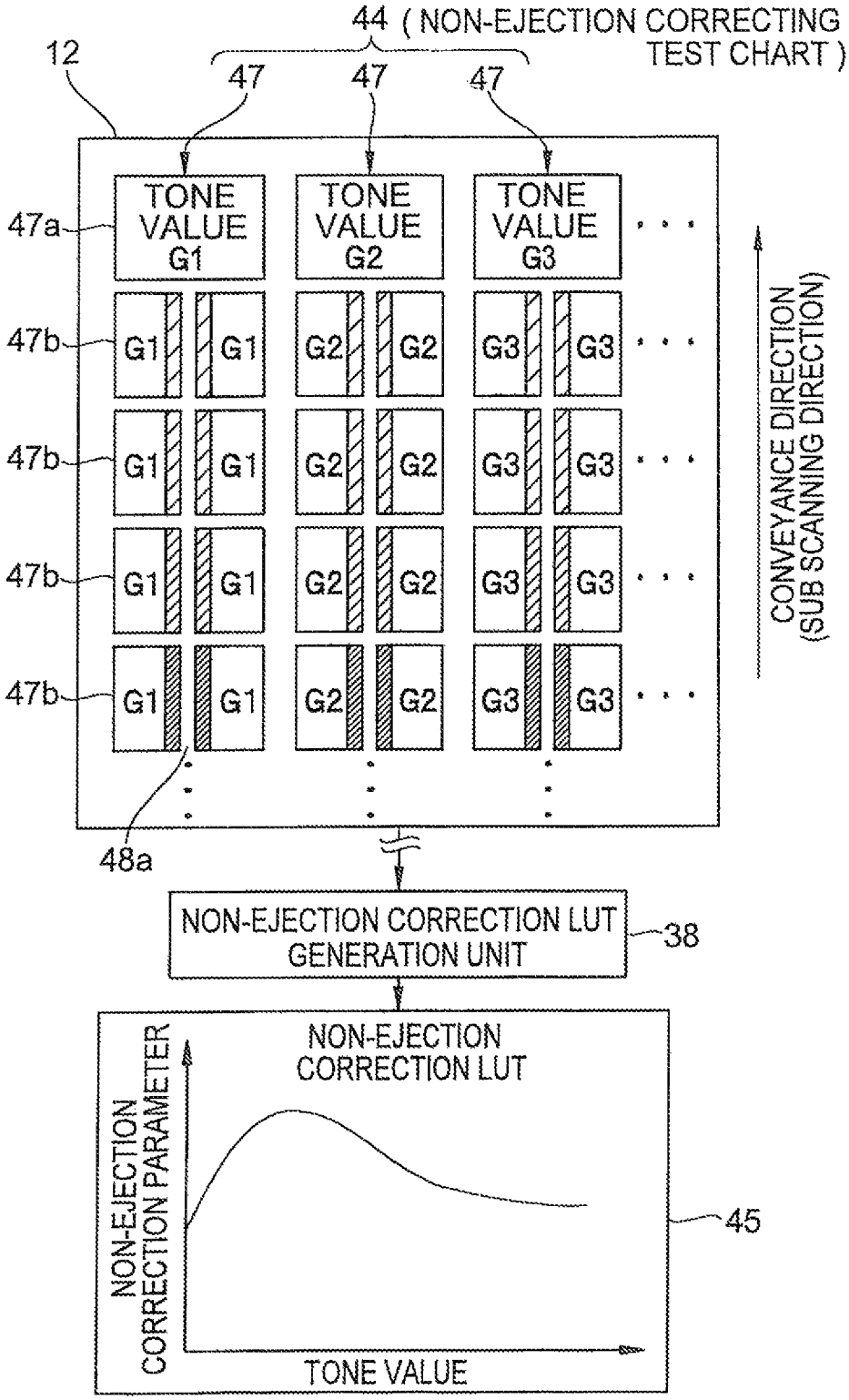
FIG. 3 is an explanatory view for explaining a process of generating a non-ejection correction LUT.

As illustrated in FIG. 3, the non-ejection correction LUT generation unit 38 generates a non-ejection correction LUT 45 based on a reading result of a non-ejection correcting test chart 44 read by the in-line sensor 21. The non-ejection correction LUT 45 may be generated (that is, a process from recording of the non-ejection correcting test chart 44 to generation of the non-ejection correction LUT 45) at any timing. The non-ejection correction LUT 45 is updated at an appropriate timing.

In the non-ejection correcting test chart 44, a plurality of patch lines 47 each composed of a plurality of patches of the same tone (G1, G2, G3, and so on) arranged along a conveyance direction (a sub-scanning direction) of the recording medium 12 are arranged in a direction (a main scanning direction) perpendicular to the conveyance direction. The respective patch lines 47 have different tone values. The tone value is gradually increased in the order of G1, G2, G3, and so on. Each of the patch lines 47 is composed of a reference patch 47*a* and a plurality of measurement patches 47*b*.

The reference patches 47*a* are uniform images respectively uniformly colored with tone values G1, G2, G3, and so on in each of the patch lines 47. The measurement patches 47*b* are formed by giving white-stripe unevenness 48*a* (a white stripe) simulating the existence of a non-ejection nozzle to the reference patch 47*a* at one position or more. A non-ejection correction parameter (a correction coefficient) is actually or simulatively applied (displayed as hatching in the drawing) to both sides of the white-stripe unevenness 48*a* in each of the measurement patches 47*b*. Non-ejection correction parameters having different values are applied to the respective measurement patches 47*b* in each of the patch lines 47.

The non-ejection correction LUT generation unit 38 selects a measurement patch 47*b*, to which a non-ejection correction parameter that achieves best visibility (allows the white-stripe unevenness 48*a* to be least noticeable) is applied, in each of the patch lines 47 based on the reading result of the non-ejection correcting test chart 44. Accordingly, the best non-ejection correction parameter is determined for each tone value (also referred to as a basic image setting value), and the non-ejection correction LUT 45 is obtained. The non-ejection correction LUT 45 in the drawing is merely one example of the non-ejection correction LUT. The non-ejection correction LUT generation unit 38 stores the non-ejection correction LUT 45 in the nozzle ejection correction data storage unit (simply abbreviated to a data storage unit below) 28.

(Defective Nozzle Detecting Process)

Figure 4:
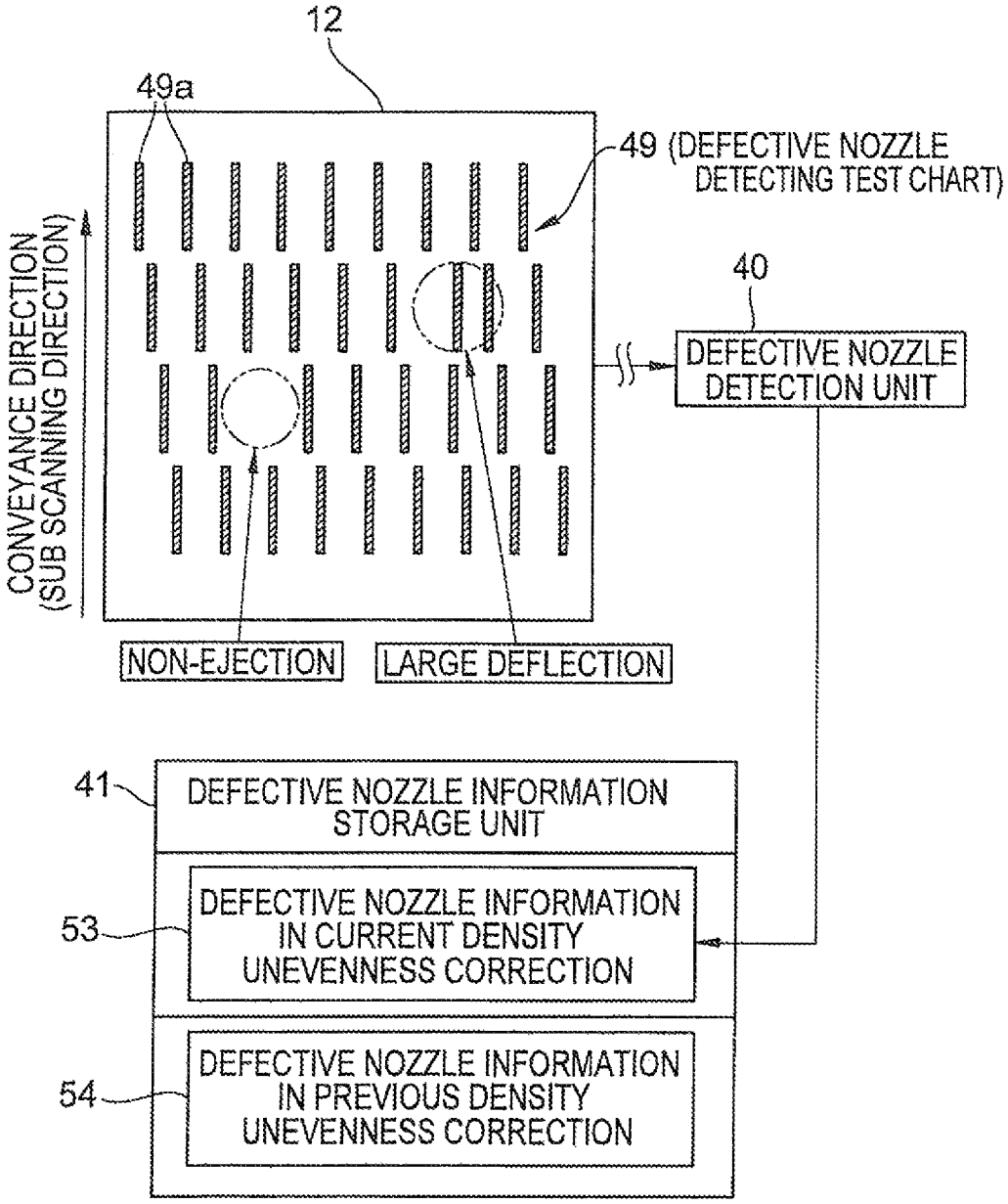
FIG. 4 is an explanatory view for explaining a process of detecting a defective nozzle.

As illustrated in FIG. 4, the defective nozzle detection unit 40 detects the defective nozzle $\mathbf{11}_{NG}$ out of the respective nozzles 11A of the ink-jet head 11 based on a reading result of a defective nozzle detecting test chart 49 read by the in-line sensor 21.

A defective nozzle detecting process from generation of the defective nozzle detecting test chart 49 to output of defective nozzle information is executed based on a command from the printing process control unit 30. The defective nozzle detecting process is executed at any timing such as every time a predetermined time has elapsed, every time image recording of a predetermined number of sheets has been performed, and immediately before an image recording process (also referred to as a printing process) based on the image data 18.

The defective nozzle detecting test chart 49 is composed of line patterns 49*a* respectively recorded on the recording medium 12 by the respective nozzles 11A of the ink-jet head 11 based on the command from the printing process control unit 30. In the defective nozzle detecting test chart 49, the line patterns 49*a* of adjacent nozzles 11A adjacent to each other are not overlapped with each other, so that an independent line pattern 49*a* (separated by each nozzle 11A) is formed for each of all the nozzles 11A so as to be distinct from each other. Therefore, the defective nozzle detecting test chart 49 is a line pattern of so-called "1 on n off" type. The defective nozzle detecting test chart 49 is formed for each of the ink-jet heads 11 having different ink colors.

In the defective nozzle detecting test chart 49, a missing line pattern 49*a* corresponding to a non-ejection nozzle is generated as illustrated by "non-ejection" in a rectangular frame in the drawing. In the defective nozzle detecting test chart 49, the deflected line pattern 49*a* corresponding to a largely-deflected nozzle, the amount of ink flight deflection of which is increased (e.g., having an inclined angle equal to or larger than a predetermined angle with respect to the conveyance direction), is generated as illustrated by "large deflection" in a rectangular frame in the drawing. Therefore, the position of the defective nozzle $\mathbf{11}_{NG}$ such as the non-ejection nozzle and the largely-deflected nozzle can be identified based on the reading result of the defective nozzle detecting test chart 49. The defective nozzle $\mathbf{11}_{NG}$ is not limited to the non-ejection nozzle and the largely-deflected nozzle, but includes an ejection malfunction nozzle where various ejection malfunctions occur.

The defective nozzle detecting test chart 49 may also include another pattern such as another line block (e.g., a block for checking a position error between line blocks) or a horizontal line (a partition line) for separating line blocks in addition to the line pattern of "1 on n off" type.

The defective nozzle detection unit 40 detects the position of the defective nozzle $\mathbf{11}_{NG}$ by analyzing the reading result of the defective nozzle detecting test chart 49. The defective nozzle detection unit 40 generates defective nozzle information indicating the position (e.g., a nozzle number), and outputs the defective nozzle information to the defective nozzle information storage unit (a second storage unit) 41.

The defective nozzle information (defective recording element information) input from the defective nozzle detection unit 40 is cumulatively stored in the defective nozzle information storage unit 41. The defective nozzle information storage unit 41 stores the latest defective nozzle information newly input from the defective nozzle detection unit 40 as defective nozzle information in current density unevenness correction (simply referred to as current defective nozzle information below) 53. The defective nozzle information storage unit 41 also stores the defective nozzle information used in previous update of a density unevenness correction LUT 59 (see FIGS. 2 and 5) described below as defective nozzle information in previous density unevenness correction (simply referred to as previous defective nozzle information below) 54. The current defective nozzle information 53 is updated every time the detection of the defective nozzle $\mathbf{11}_{NG}$ is executed by the defective nozzle detection unit 40 during a period from the previous update of the density unevenness correction LUT 59 to next update of the density unevenness correction LUT 59. When the next update of the density unevenness correction LUT 59 is conducted, the current defective nozzle information 53 at the point of time is stored as the previous defective nozzle information 54.

In the following, a series of processes including the recording of the defective nozzle detecting test chart 49 by the marking unit 20, the reading thereof by the in-line sensor 21, the detection of the defective nozzle $\mathbf{11}_{NG}$ by the defective nozzle detection unit 40, and the registration of the defective nozzle information in the defective nozzle information storage unit 41 are called "defective nozzle detecting process" (see parenthesized numbers (1) to (3) in FIG. 11).

(Density Unevenness Correction LUT Generating Process)

Figure 5:
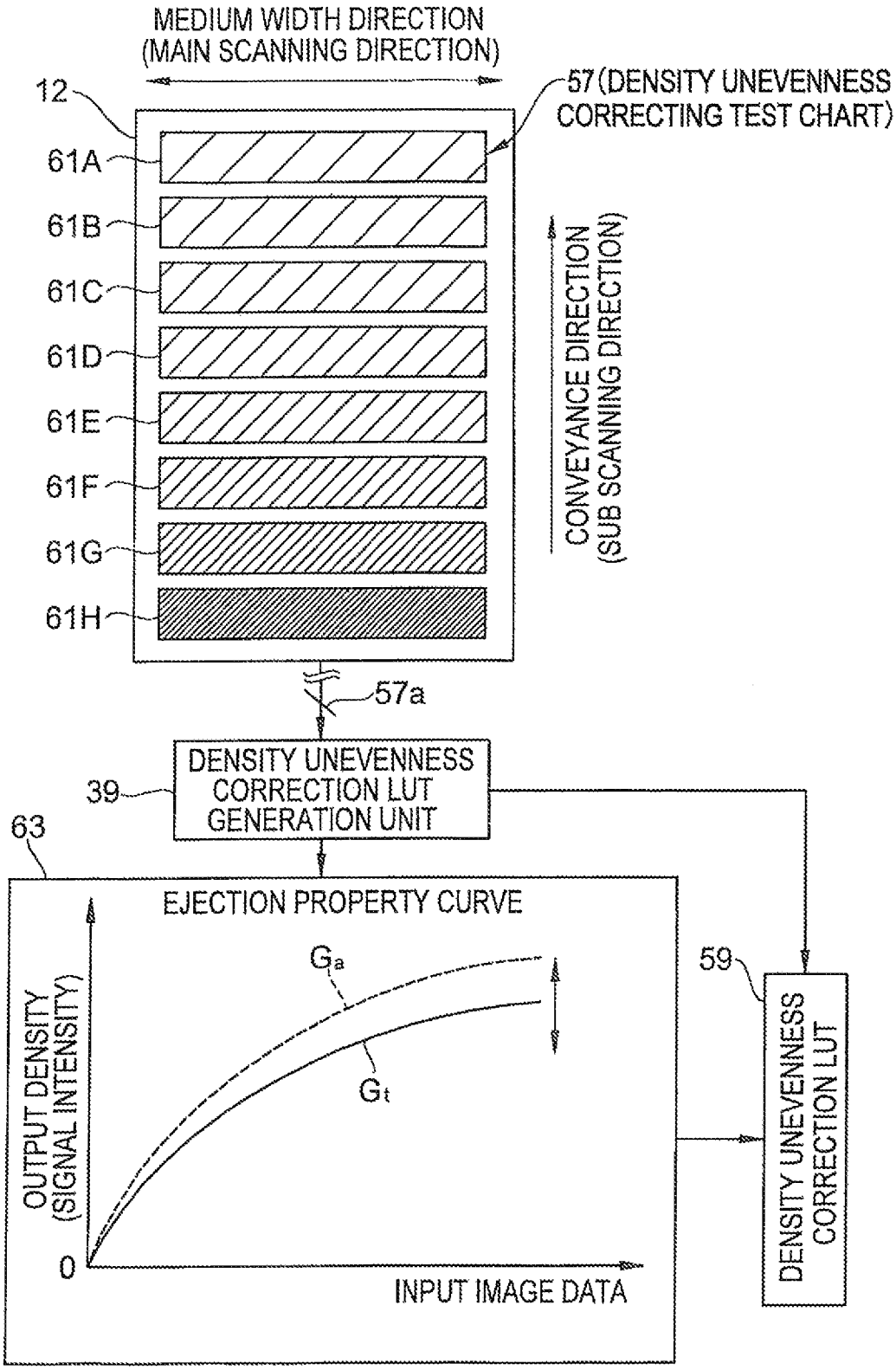
FIG. 5 is an explanatory view for explaining a process of generating a density unevenness correction LUT.

As illustrated in FIG. 5, the density unevenness correction LUT generation unit 39 generates the density unevenness correction LUT (unevenness correcting information) 59 based on a reading result of a density unevenness correcting test chart 57 read by the in-line sensor 21. Examples of a timing of generating the density unevenness correction LUT 59 (a process from recording of the density unevenness correcting test chart 57 to generation of the density unevenness correction LUT 59) include various modes similarly to the non-ejection correction LUT 45. The density unevenness correction LUT 59 is updated at an appropriate timing.

The density unevenness correcting test chart 57 includes a plurality of types of band-like patterns 61A to 61H with different tone values (i.e., densities). Each of the band-like patterns 61A to 61H has a rectangular shape long in a medium width direction (the main scanning direction) perpendicular to the conveyance direction (the sub-scanning direction). Each of the band-like patterns 61A to 61H is formed with a substantially uniform density within a range corresponding to the length of a line of the nozzles 11A. The "substantially uniform density" means that a tone command value (setting value) is constant when the pattern is recorded. By measuring a density distribution of the pattern drawn based on the command of a constant tone value, variations in the ejection properties of the respective nozzles 11A corresponding to the tone value can be grasped. The pattern arrangement order or the number of band-like patterns (the number of steps of changing the tone value) can be changed as appropriate.

The density unevenness correction LUT generation unit 39 analyzes reading result data 57*a* (property information) of the density unevenness correcting test chart 57, and acquires output density data indicating the output recording density (the ink density) of each of the nozzles 11A corresponding to each position in the reading result. The density unevenness correction LUT generation unit 39 obtains a property curve 63 indicating the ejection property of each of the nozzles 11A based on the output density data and the input tone value of each of the patterns 61A to 61H.

The property curve 63 in the drawing is merely one example. The horizontal axis represents the input image data (the input tone value), and the vertical axis represents the output density. A curve Gt in the drawing represents the property curve of the nozzle 11A acquired from the reading result data 57*a*. A curve Ga indicated by a dashed line in the drawing represents a property curve (an appropriate property curve) obtained when appropriate ink ejection assumed in design is performed. As illustrated in the drawing, the actual property curve Gt of the nozzle 11A normally forms a curve slightly shifted from the appropriate property curve due to production tolerances or other factors. There is observed a variation in the output density value between the respective nozzles 11A as indicated by a vertical bidirectional arrow in the drawing. The density unevenness correction LUT generation unit 39 compares the property curve Gt and the appropriate property curve Ga of each of the nozzles 11A. Based on the comparison result, the density unevenness correction LUT generation unit 39 generates the density unevenness correction LUT 59 indicating a table of a correction value for ejection control of the object nozzle 11A. The density unevenness correction LUT generation unit 39 stores the density unevenness correction LUT 59 in the data storage unit 28.

(Preliminary Modification: Flattening Processing)

Returning to FIG. 2, the LUT preliminary modification unit 42 includes a defective nozzle information acquisition unit (a defective recording element information acquisition unit) 42*a*, and a flattening processing unit 42*b*. The defective nozzle information acquisition unit 42*a* acquires the current defective nozzle information 53 and the previous defective nozzle information 54 from the defective nozzle information storage unit 41 when a timing of updating the density unevenness correction LUT 59 arrives. The timing of updating the density unevenness correction LUT 59 here is any timing such as every time a predetermined time has elapsed, every time image recording of a predetermined number of sheets has been performed, and immediately before the image recording process. The timing of updating the density unevenness correction LUT 59 is independent of the timing of the defective nozzle detecting process described above. Therefore, the timing of updating the density unevenness correction LUT 59 does not always correspond to the timing of the defective nozzle detecting process. Thus, the defective nozzle information acquisition unit 42*a* acquires the latest current defective nozzle information 53 from the defective nozzle information storage unit 41.

The flattening processing unit 42*b* conducts preliminary modification by performing flattening processing described below on the latest (current) density unevenness correction LUT 59 stored in the data storage unit 28 based on the respective defective nozzle information 53 and 54 acquired by the defective nozzle information acquisition unit 42*a* when the timing of updating the density unevenness correction LUT 59 arrives. The flattening processing unit 42*b* stores in the data storage unit 28 a preliminary density unevenness correction LUT 65 generated by performing the flattening processing on the density unevenness correction LUT 59. Therefore, density unevenness correction based on the preliminary density unevenness correction LUT 65 is performed on density unevenness correcting test chart data (simply referred to as test chart data below) 67 as the image data of the density unevenness correcting test chart 57 in the nozzle ejection correction processing unit 23. The test chart data 67 is stored in the memory 31, and output to the printer 13 from the PC 14 when the density unevenness correcting test chart 57 is recorded.

<Nozzle Ejection Correction Processing Unit>

The nozzle ejection correction processing unit 23 functions as a density unevenness correction processing unit (a first output correction unit) 70 and a non-ejection correction processing unit (a second output correction unit) 71 by executing the control program 35 upon receiving a command from the printing process control unit 30.

(Density Unevenness Correction of the Image Data)

The density unevenness correction processing unit 70 executes density unevenness correction to perform signal conversion processing on an image signal of the image data 18 subjected to the tone conversion processing in the tone conversion processing unit 22 based on the density unevenness correction LUT 59 in the data storage unit 28.

Figure 6:
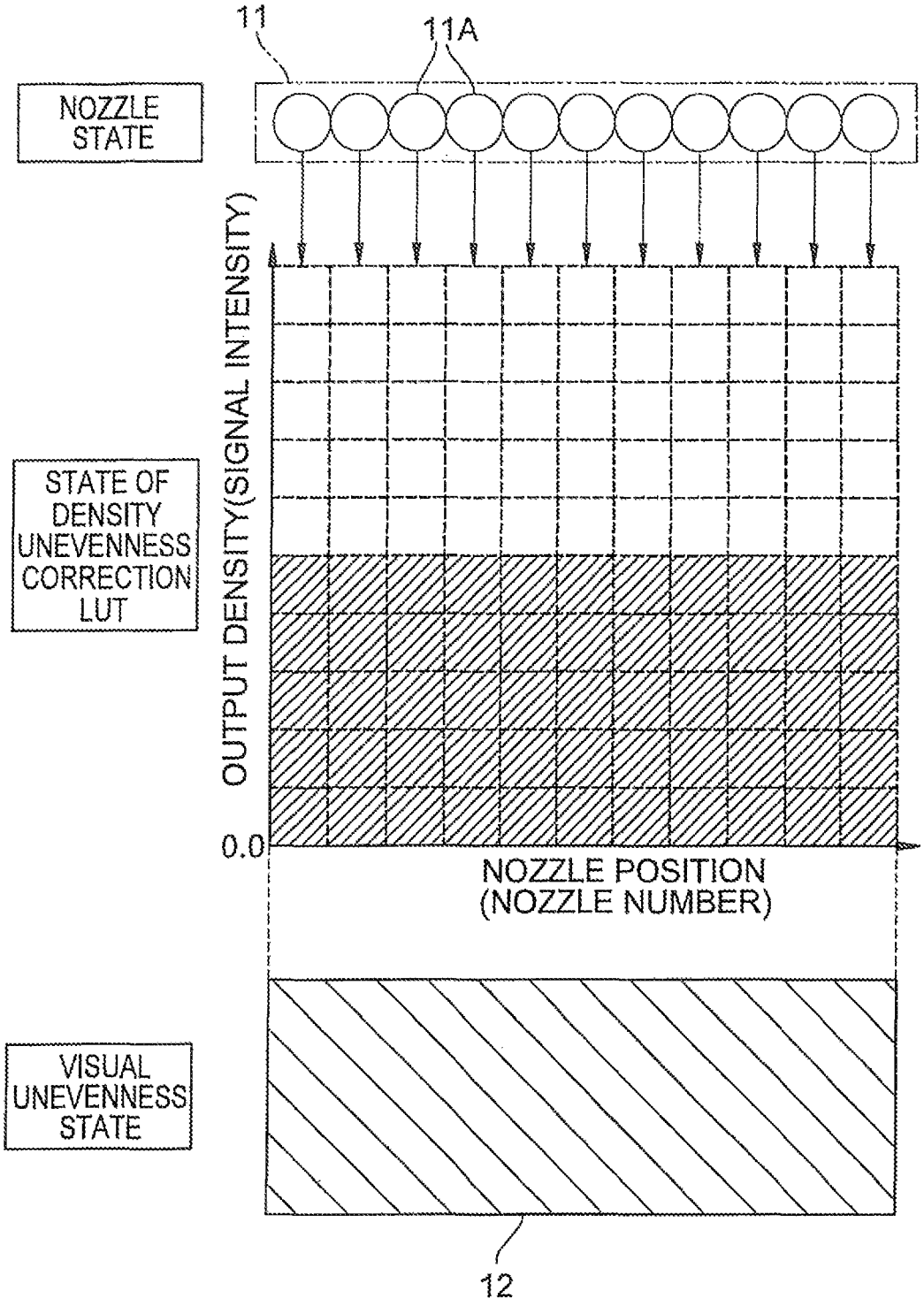
FIG. 6 is an explanatory view for explaining the density unevenness correction LUT when nozzles are normal.
Figure 7:
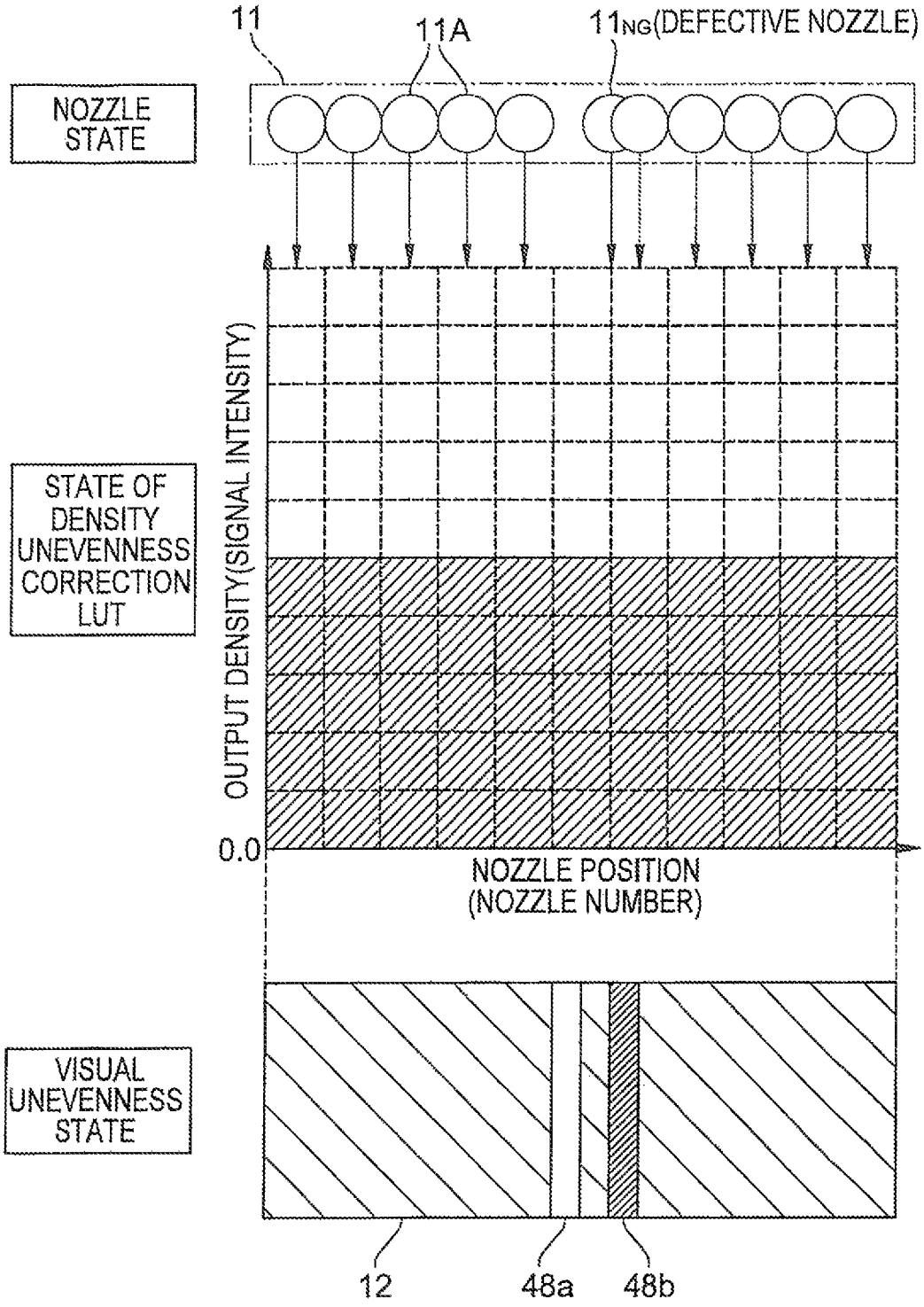
FIG. 7 is an explanatory view for explaining occurrence of stripe unevenness caused by a defective nozzle.
Figure 8:
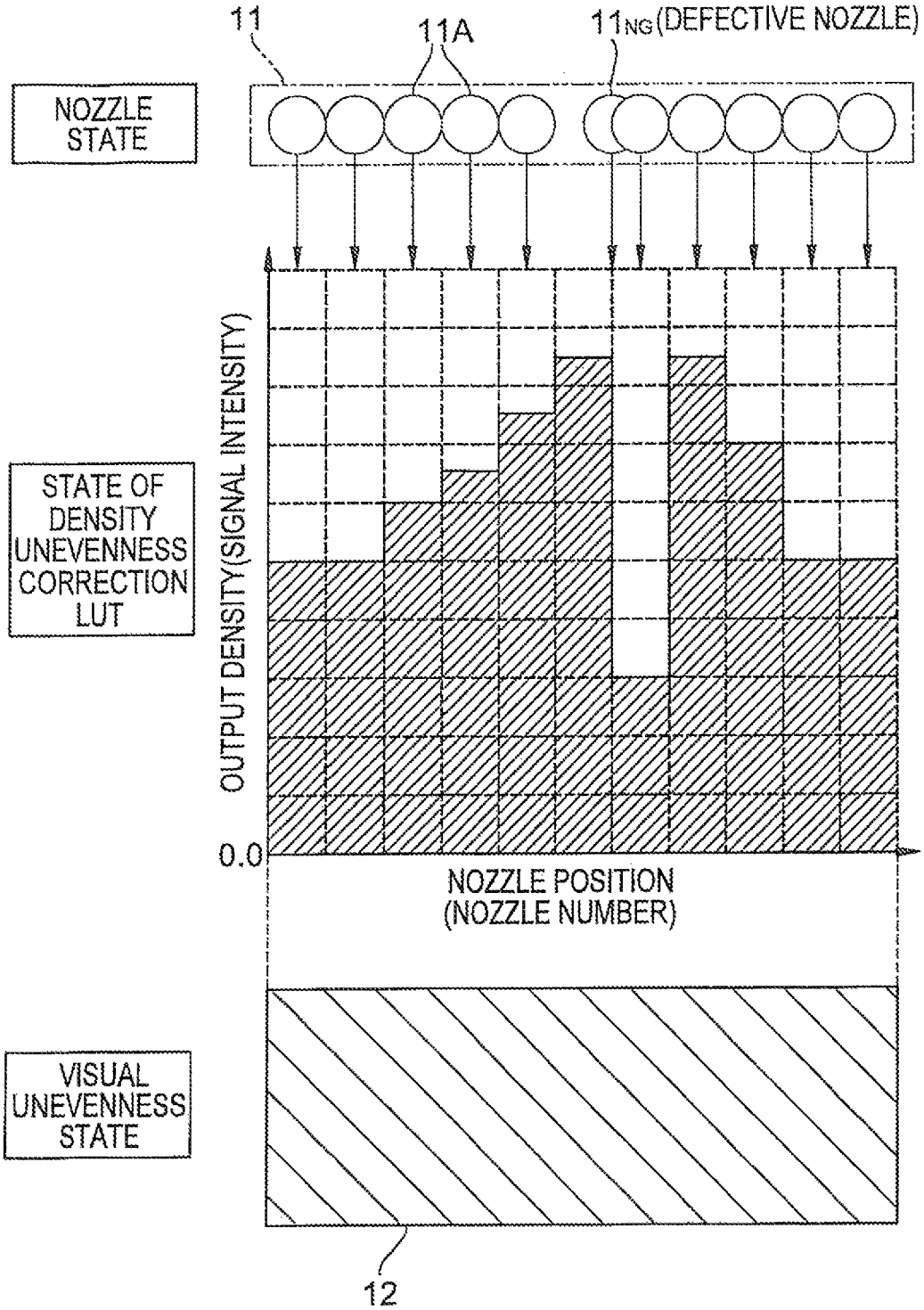
FIG. 8 is an explanatory view for explaining the density unevenness correction LUT used in density unevenness correction.

As illustrated in FIG. 6, when the ejection states of the respective nozzles 11A are stable, the density unevenness correction LUT 59 has a flat state. In the drawings subsequent to FIG. 6, the states (correction values) of the density unevenness correction LUT 59, the preliminary density unevenness correction LUT 65, and the non-ejection correction LUT 45 are shown by the output densities of the respective nozzles 11A after correction. When the defective nozzle $\mathbf{11}_{NG}$ such as the largely-deflected nozzle is generated in the respective nozzles 11A, white-stripe unevenness 48*a* or black-stripe unevenness 48*b* occurs as illustrated in FIG. 7. Therefore, as illustrated in FIG. 8, the density unevenness correction processing unit 70 performs the density unevenness correction processing on the image signal based on the density unevenness correction LUT 59 generated after the defective nozzle $\mathbf{11}_{NG}$ is generated. Accordingly, the output densities of the respective nozzles 11A are corrected, and the visual stripe unevenness 48*a* and 48*b* can be eliminated.

Meanwhile, the density unevenness correction processing unit 70 executes density unevenness correction to perform signal conversion processing on an image signal of the test chart data 67 subjected to the tone conversion processing in the tone conversion processing unit 22 based on the preliminary density unevenness correction LUT 65 in the data storage unit 28.

(Non-Ejection Correction)

Returning to FIG. 2, the non-ejection correction processing unit 71 performs non-ejection correction processing on the image signal subjected to the density unevenness correction processing in the density unevenness correction processing unit 70 based on the non-ejection correction LUT 45 in the data storage unit 28 and the current defective nozzle information 53 in the defective nozzle information storage unit 41.

Figure 9:
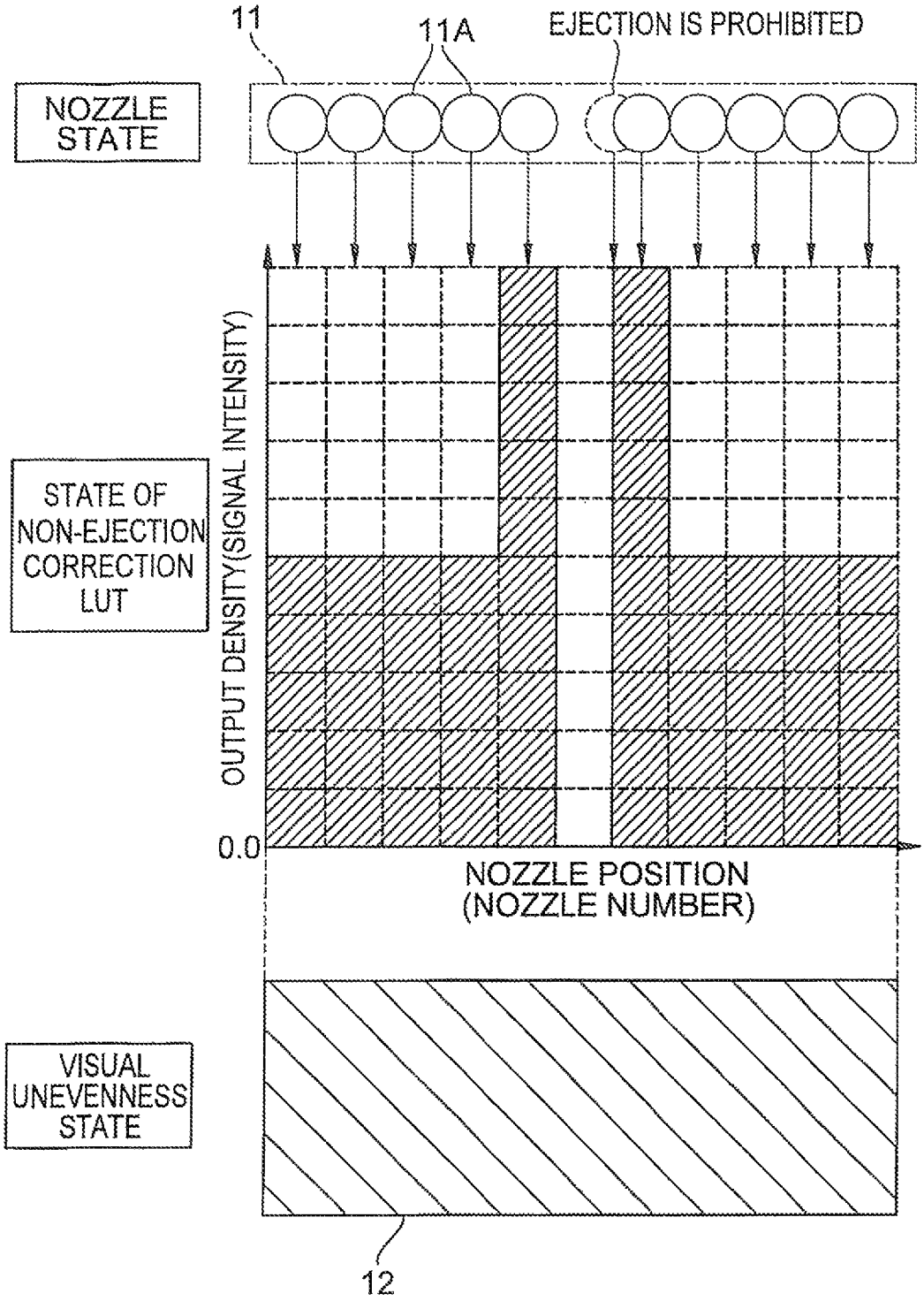
FIG. 9 is an explanatory view for explaining a non-ejection correction LUT used in non-ejection correction.

When the defective nozzle $\mathbf{11}_{NG}$ such as the largely-deflected nozzle is generated in the respective nozzles 11A as illustrated in FIG. 7, the non-ejection correction processing unit 71 identifies the position (the nozzle number or the like) of the defective nozzle $\mathbf{11}_{NG}$ by reference to the current defective nozzle information 53. As illustrated in FIG. 9, the non-ejection correction processing unit 71 performs output suspension processing to suspend ink ejection (output) of the identified defective nozzle $\mathbf{11}_{NG}$. The non-ejection correction processing unit 71 also performs signal conversion processing on image signals corresponding to normal nozzles 11A adjacent to the defective nozzles $\mathbf{11}_{NG}$ (referred to as an adjacent nozzle 11A below) so as to increase the ink ejection amounts of the adjacent nozzles 11A based on the non-ejection correction LUT 45. By performing the non-ejection correction processing to suspend the ink ejection from the defective nozzle $\mathbf{11}_{NG}$ and increase the output densities of the adjacent nozzles 11A as described above, the visual white and black-stripe unevenness 48*a* and 48*b* can be eliminated.

Here, the defective nozzle $\mathbf{11}_{NG}$ subjected to the output suspension processing is, for example, a nozzle that causes at least one of the visual white and black-stripe unevenness 48*a* and 48*b*. The adjacent nozzle 11A is not limited to a nozzle adjacent to the defective nozzle $\mathbf{11}_{NG}$, and also includes a nozzle 11A for recording a pixel adjacent to a pixel corresponding to the defective nozzle $\mathbf{11}_{NG}$, that is, a nozzle not necessarily adjacent to the defective nozzle $\mathbf{11}_{NG}$. The output densities of not only the adjacent nozzle 11A, but a nozzle 11A around the adjacent nozzle 11A may also be increased.

Moreover, in the present embodiment, the defective nozzle $\mathbf{11}_{NG}$ subjected to the output suspension processing is determined based on the current defective nozzle information 53. However, the history of the defective nozzle information may be stored, and ink ejection from a nozzle 11A determined as the defective nozzle $\mathbf{11}_{NG}$ even once may be suspended.

<Preliminary Modification: Flattening Processing>

Figure 10:
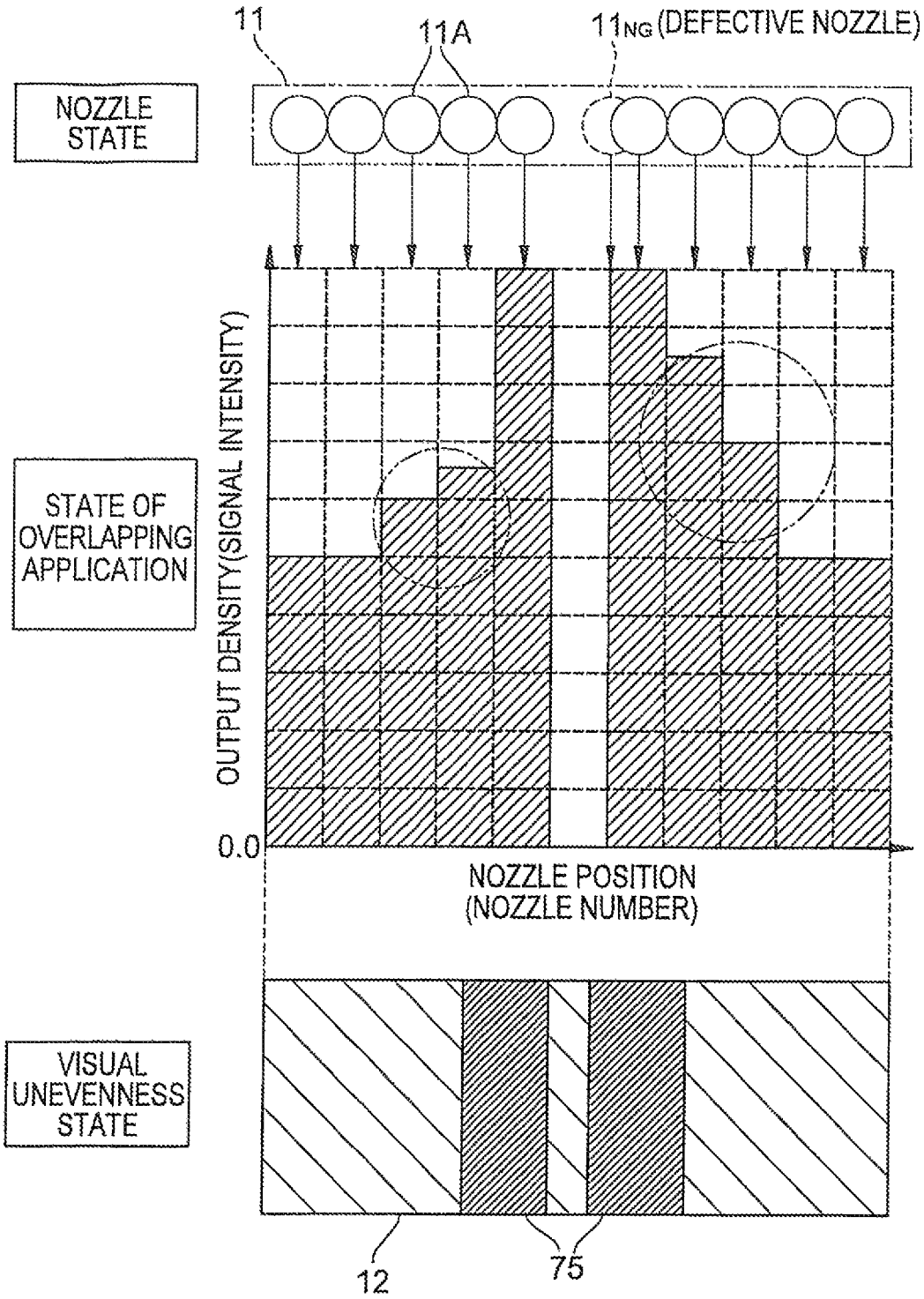
FIG. 10 is an explanatory view for explaining occurrence of overlapping overcorrection stripe unevenness caused by overlapping correction of density unevenness correction and non-ejection correction.

Next, the flattening processing of the density unevenness correction LUT 59 by the LUT preliminary modification unit 42 is described. The density unevenness correction processing and the non-ejection correction processing described above are performed independently of each other. Therefore, when flight deflection of ink ejected from the nozzle 11A already occurs in, for example, the previous generation (update) of the density unevenness correction LUT 59, the density unevenness correction LUT 59 is adjusted so as to be able to correct the flight deflection as illustrated in FIG. 8. When the above nozzle 11A is detected as the defective nozzle $\mathbf{11}_{NG}$ with the amount of ink flight deflection of the nozzle 11A further increased before the next update of the density unevenness correction LUT 59, the non-ejection correction is further executed. Thus, the density unevenness correction and the non-ejection correction are applied in an overlapping manner as illustrated in FIG. 10 (a portion encircled by an alternate long and two short dashes line), so that overlapping overcorrection stripe unevenness 75 occurs in an image recorded by nozzles 11A around the defective nozzle $\mathbf{11}_{NG}$.

Thus, when a new defective nozzle $\mathbf{11}_{NG}$ is detected after the previous update of the density unevenness correction LUT 59 at the current timing of updating the density unevenness correction LUT 59, the flattening processing unit 42*b* performs the flattening processing on the latest density unevenness correction LUT 59. That is, the flattening processing by the flattening processing unit 42*b* is executed before the recording of the density unevenness correcting test chart 57 is started. The latest density unevenness correction LUT 59 is the density unevenness correction LUT 59 generated in the previous update by the density unevenness correction LUT generation unit 39.

Figure 11:
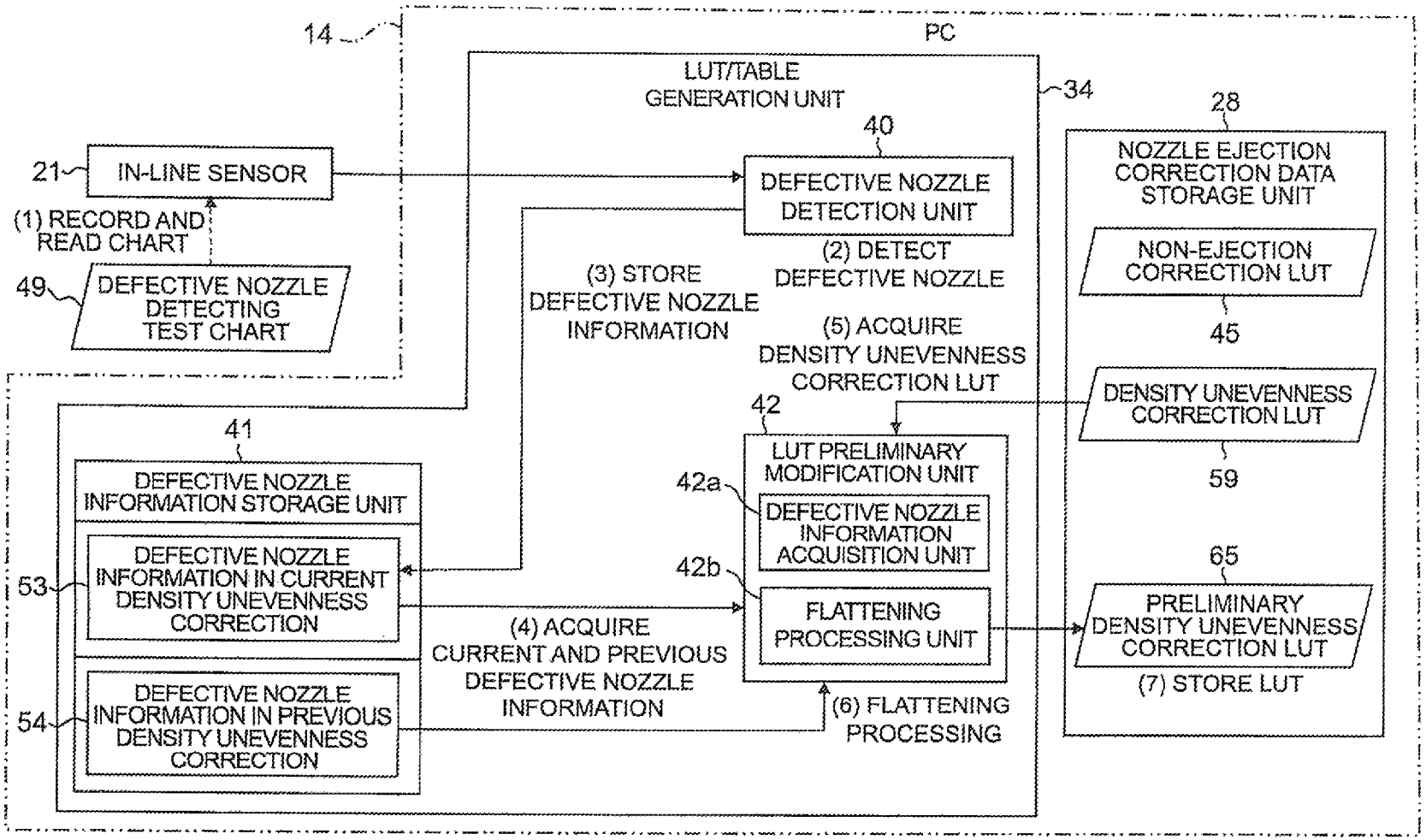
FIG. 11 is an explanatory view for explaining a process of generating a preliminary density unevenness correction LUT.

As illustrated in FIG. 11, the defective nozzle detecting process indicated by parenthesized numbers (1) to (3) is repeatedly executed at the timing independent of the timing of updating the density unevenness correction LUT 59. The defective nozzle information acquisition unit 42*a* acquires the previous defective nozzle information 54 at the previous update timing, and the latest current defective nozzle information 53 from the defective nozzle information storage unit 41 as indicated by a parenthesized number (4) when the timing of updating the density unevenness correction LUT 59 arrives. The respective defective nozzle information 53 and 54 are input to the flattening processing unit 42*b* from the defective nozzle information acquisition unit 42*a*.

The flattening processing unit 42*b* determines whether or not the new defective nozzle $\mathbf{11}_{NG}$ is detected after the previous update of the density unevenness correction LUT 59 by comparing a difference between the current defective nozzle information 53 and the previous defective nozzle information 54. When the new defective nozzle $\mathbf{11}_{NG}$ is detected, the flattening processing unit 42*b* acquires the latest density unevenness correction LUT 59 from the data storage unit 28 as indicated by a parenthesized number (5). The flattening processing unit 42*b* performs the flattening processing on the density unevenness correction LUT 59 as indicated by a parenthesized number (6).

First, the flattening processing unit 42*b* identifies the correction values of nozzles 11A (referred to as surrounding nozzles 11A below, surrounding recording elements) located around the newly-detected defective nozzle $\mathbf{11}_{NG}$ out of the correction values of the respective nozzles 11A defined in the density unevenness correction LUT 59.

Figure 12:
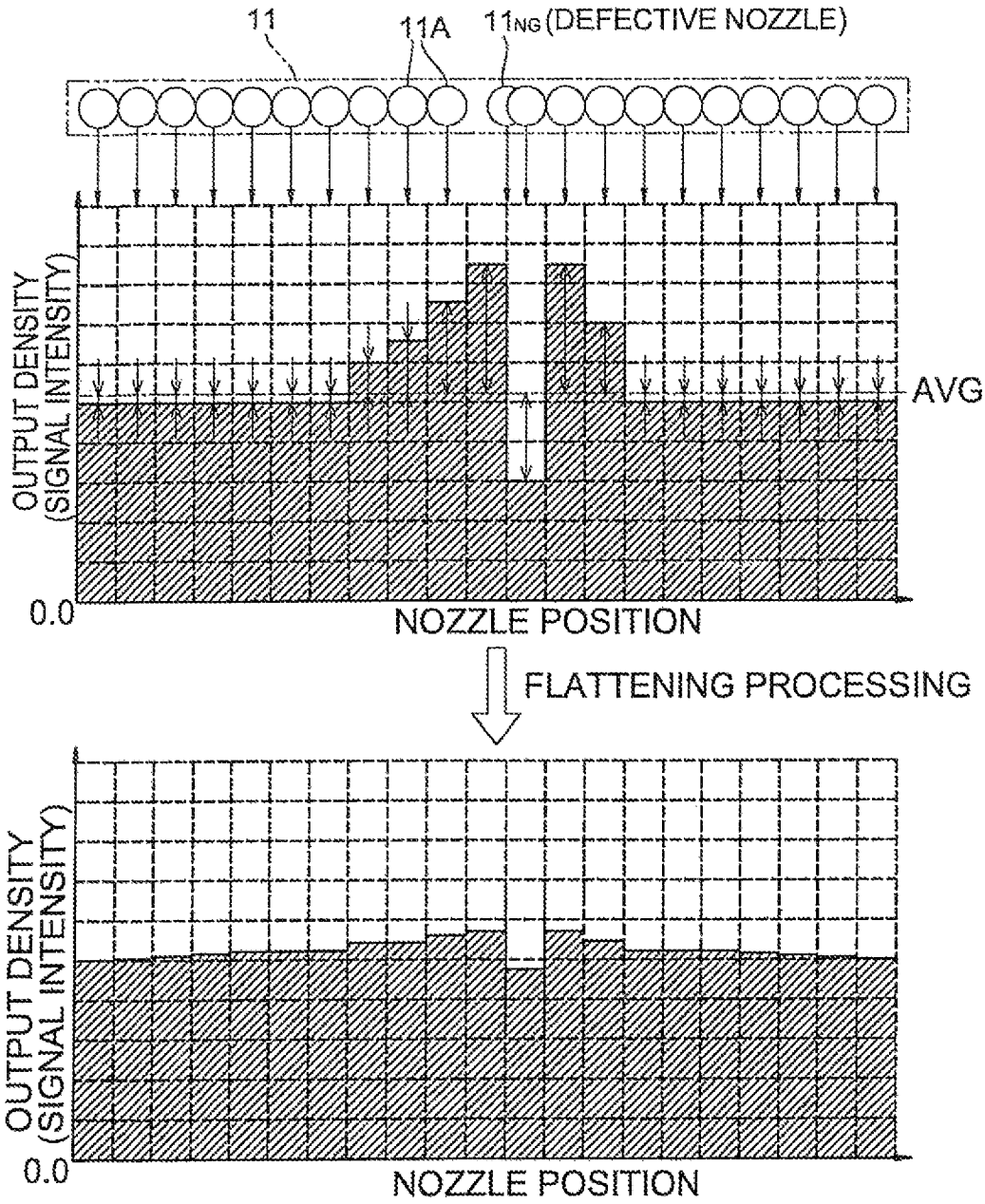
FIG. 12 is a an explanatory view for explaining flattening processing.

As illustrated in an upper stage in FIG. 12, the surrounding nozzles 11A are nozzles 11A (including the defective nozzle $\mathbf{11}_{NG}$) located within a range wider than a range in which the adjacent nozzles 11A or the like, the output densities of which are increased in the aforementioned non-ejection correction processing, are located, that is, within a range in which the overlapping correction is assumed. For example, in the present embodiment, 10 nozzles around the defective nozzle $\mathbf{11}_{NG}$ (the defective nozzle $\mathbf{11}_{NG}$ and right and left 10 nozzles) are employed as the surrounding nozzles 11A. The number may be appropriately increased or decreased. The surrounding nozzle 11A is not limited to the nozzle located around the defective nozzle $\mathbf{11}_{NG}$, and also includes a nozzle 11A for recording a pixel (e.g., right and left 10 pixels) around a pixel corresponding to the defective nozzle $\mathbf{11}_{NG}$. While the defective nozzle $\mathbf{11}_{NG}$ is also included in the surrounding nozzles 11A, the defective nozzle $\mathbf{11}_{NG}$ is assigned reference numeral "$\mathbf{11}_{NG}$," not "11A" so as to easily distinguish the defective nozzle $\mathbf{11}_{NG}$ in the drawing.

Subsequently, the flattening processing unit 42*b* performs the flattening processing to suppress variations in the correction values respectively corresponding to the surrounding nozzles 11A (simply abbreviated to a surrounding nozzle correction value below) in the density unevenness correction LUT 59. To be more specific, the flattening processing unit 42*b* calculates an average value AVG of the respective surrounding nozzle correction values. The flattening processing unit 42*b* performs the flattening processing to suppress the amplitudes of the variations in the surrounding nozzle correction values as illustrated in a lower stage in FIG. 12 by using a difference between the average value AVG and each of the surrounding nozzle correction values as the amplitude of the variation in each of the surrounding nozzle correction values (indicated by an arrow in the drawing). Accordingly, the preliminary density unevenness correction LUT 65 is generated by the flattening processing unit 42*b*. The preliminary density unevenness correction LUT 65 is generated for each tone of the object nozzle 11A.

The degree of suppressing the amplitude (the degree of bringing the correction value close to the AVG) is preferably decreased toward the outer side from a center element of a portion where the flattening processing is performed (a center nozzle of the respective surrounding nozzles 11A) when the amplitude is suppressed in the flattening processing. Accordingly, occurrence of an unnatural difference in level at a boundary between the portion where the flattening processing is performed and a portion where the flattening processing is not performed can be prevented.

Referring back to FIG. 11, the flattening processing unit 42*b* stores the preliminary density unevenness correction LUT 65 in the data storage unit 28 as indicated by a parenthesized number (7).

<Update of the Density Unevenness Correction LUT>

Figure 13:
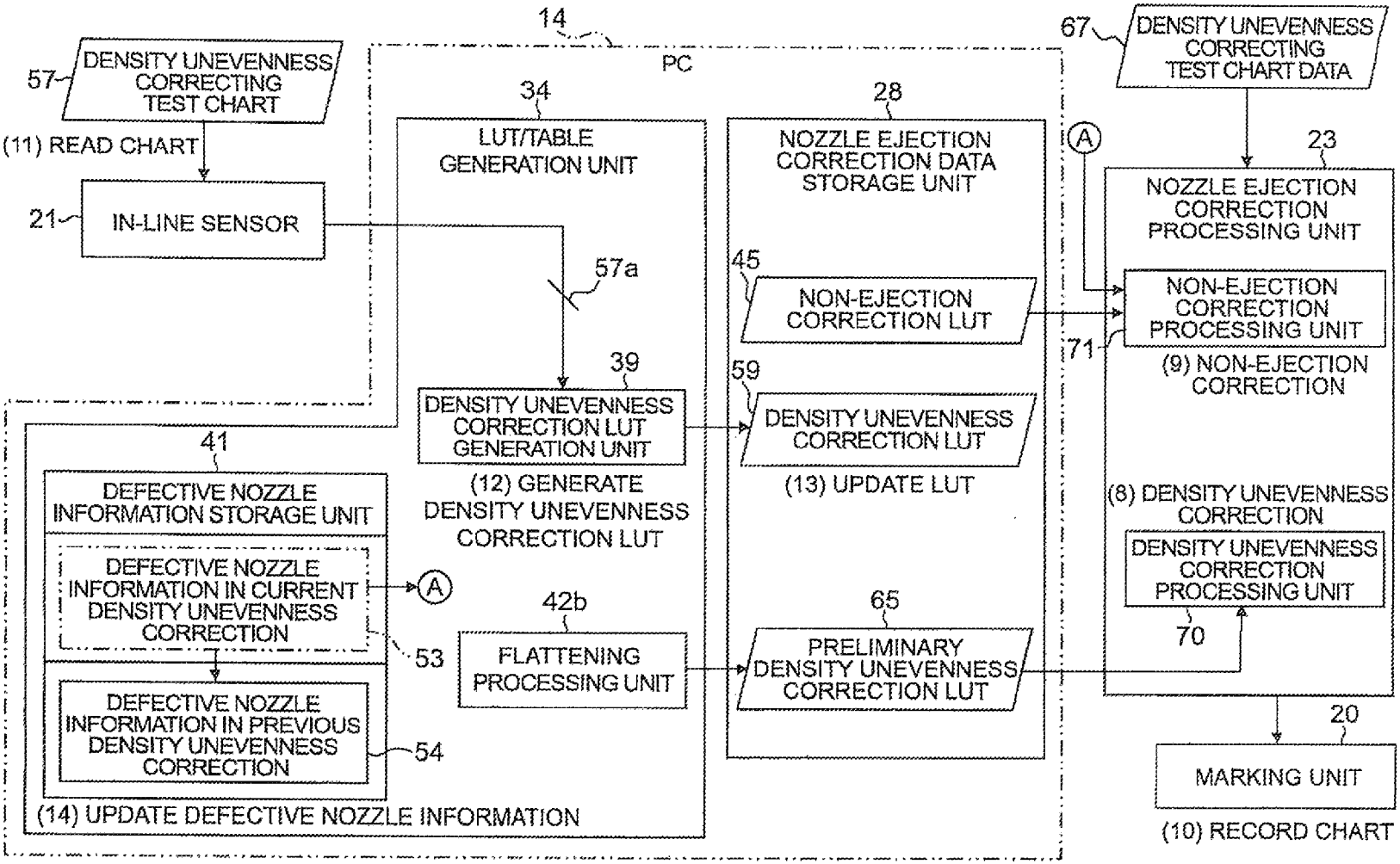
FIG. 13 is an explanatory view for explaining a process of updating the density unevenness correction LUT.

Next, a process of updating the density unevenness correction LUT 59 is described by using FIG. 13. The density unevenness correction processing unit 70 performs the density unevenness correction processing on the image signal of the test chart data 67 subjected to the tone conversion processing in the tone conversion processing unit 22 based on the preliminary density unevenness correction LUT 65 read out from the data storage unit 28 as indicated by a parenthesized number (8). The non-ejection correction processing unit 71 performs the non-ejection correction processing on the image signal subjected to the density unevenness correction processing based on the non-ejection correction LUT 45 read out from the data storage unit 28 and the current defective nozzle information 53 as indicated by a parenthesized number (9). The image signal subjected to the non-ejection correction processing is converted to the marking signal in the halftone processing unit 24, and thereafter output to the marking unit 20. Accordingly, the density unevenness correcting test chart 57 is recorded on the recording medium 12 as indicated by a parenthesized number (10).

Subsequently, the in-line sensor 21 reads the density unevenness correcting test chart 57 as indicated by a parenthesized number (11), and outputs the reading result to the density unevenness correction LUT generation unit 39. The density unevenness correction LUT generation unit 39 generates new density unevenness correction LUT 59 based on the reading result of the density unevenness correcting test chart 57 as indicated by a parenthesized number (12), and outputs the density unevenness correction LUT 59 to the data storage unit 28. Accordingly, the density unevenness correction LUT 59 in the data storage unit 28 is updated as indicated by a parenthesized number (13). The defective nozzle information storage unit 41 overwrites the preceding previous defective nozzle information 54 by employing the current defective nozzle information 53 as new previous defective nozzle information 54 as indicated by a parenthesized number (14).

The printing process control unit 30 updates the density unevenness correction LUT 59 by controlling the respective units of the PC 14 and the respective units of the printer 13 to repeat the processes indicated by the parenthesized numbers (1) to (14) every time the timing of updating the density unevenness correction LUT 59 arrives.

<Operation of the Printing System>

Figure 14:
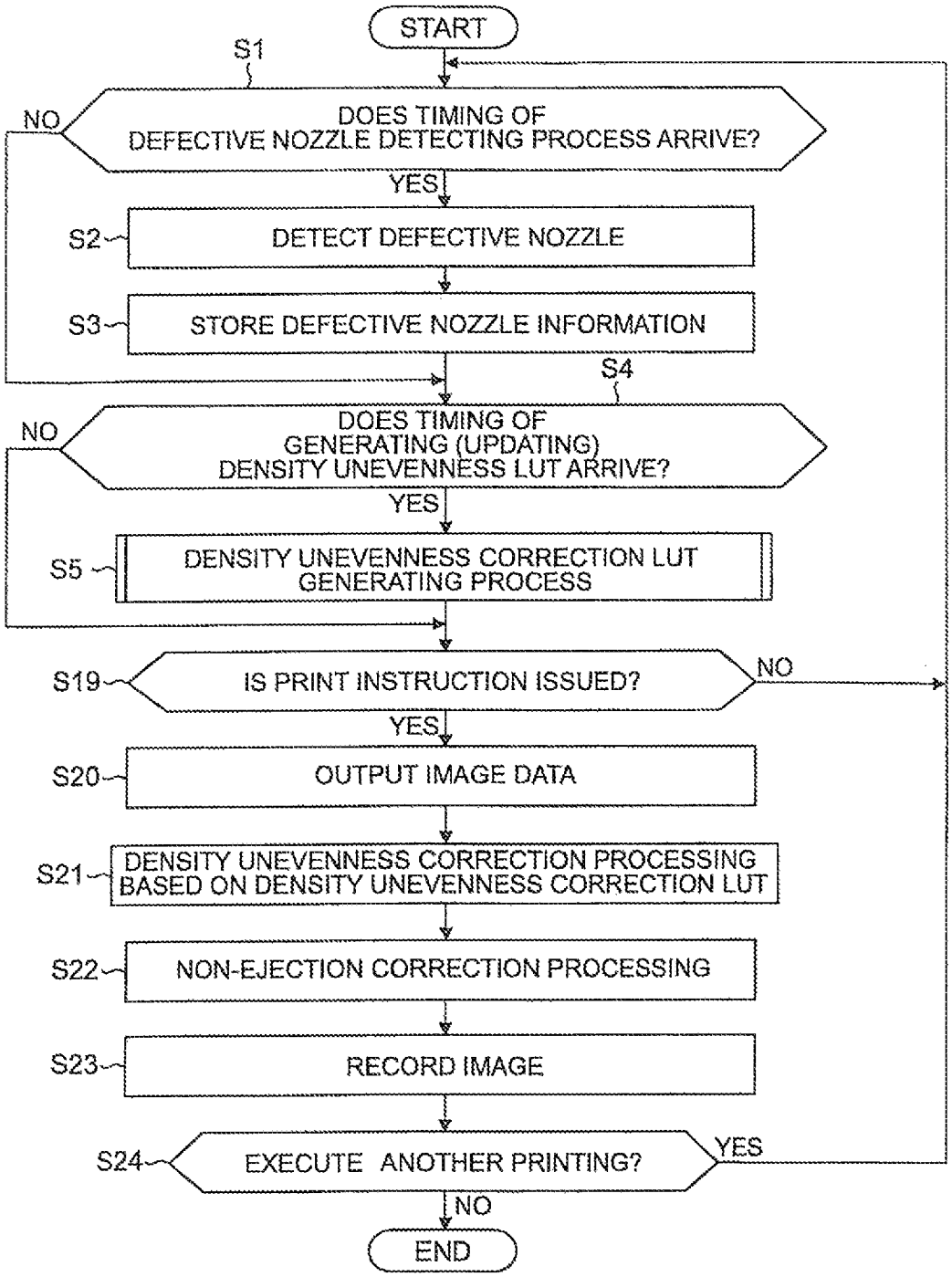
FIG. 14 is a flowchart illustrating a flow of an image recording process of the ink-jet printing system.

Next, the operation of the printing system 10 having the aforementioned configuration, particularly, the process of generating (updating) the density unevenness correction LUT 59 is described by using a flowchart illustrated in FIG. 14. The printing process control unit 30 sequentially determines whether or not the predetermined timing of the defective nozzle detecting process described above arrives, or whether or not the timing of generating (updating) the density unevenness correction LUT 59 arrives. When determining that the timing of the defective nozzle detecting process arrives, the printing process control unit 30 operates the respective units of the printer 13 and the PC 14 to start the defective nozzle detecting process (YES in step S1).

The printing process control unit 30 outputs the data of the defective nozzle detecting test chart 49 to the printer 13, and issues a test chart record command to the printer 13. Upon receiving the command, the defective nozzle detecting process indicated by the parenthesized numbers (1) to (3) in FIG. 11 is executed, and the current defective nozzle information 53 is stored in the defective nozzle information storage unit 41 (steps S2, S3, a defective recording element detection step).

(First Process of Generating the Density Unevenness Correction LUT)

When determining that the timing of generating (updating) the density unevenness correction LUT 59 arrives, the printing process control unit 30 starts the process of generating the density unevenness correction LUT 59 (YES in step S4, step S5).

Figure 15:
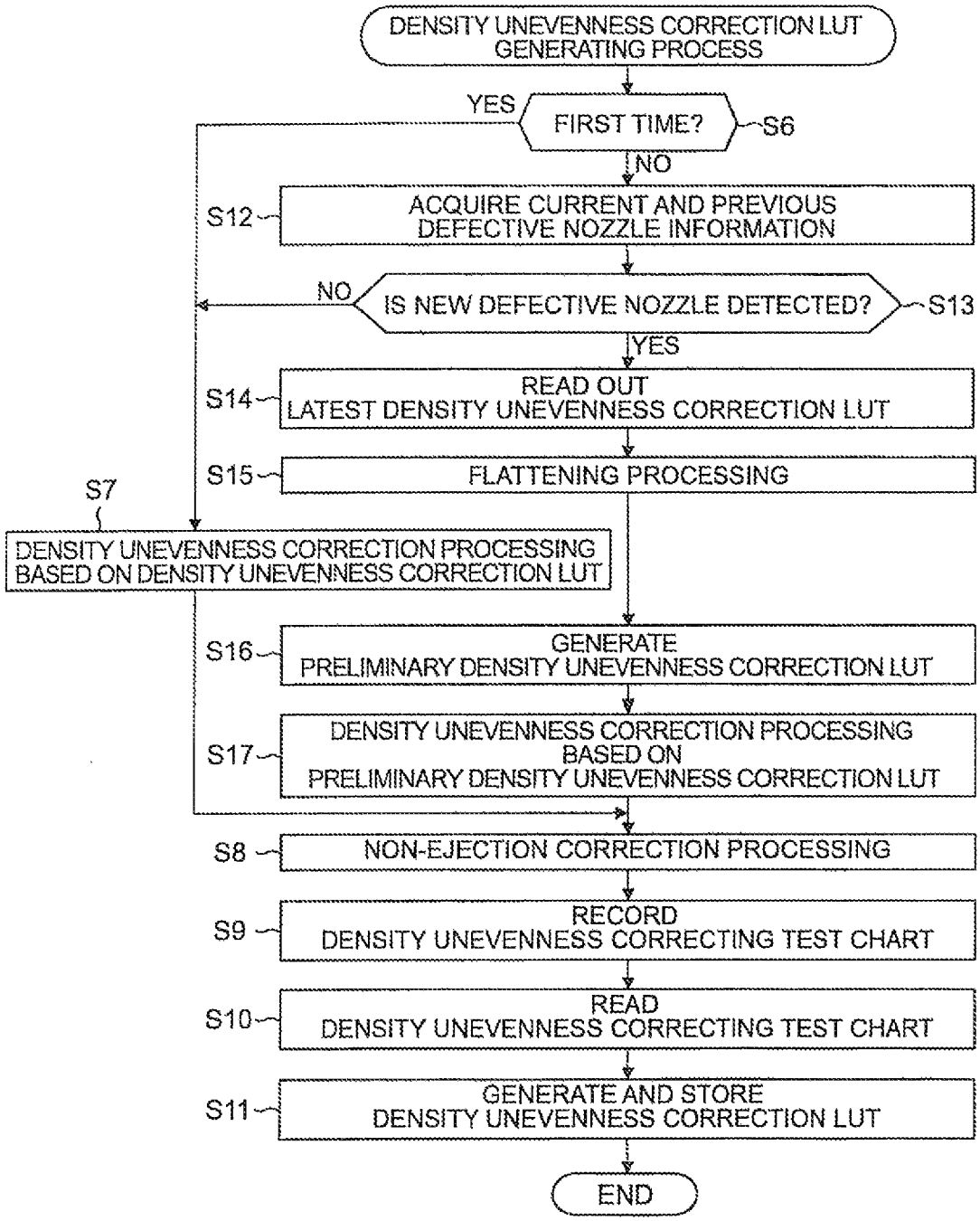
FIG. 15 is a flowchart illustrating a flow of the process of generating (updating) the density unevenness correction LUT.

As illustrated in FIG. 15, when the current process of generating the density unevenness correction LUT 59 is performed for "first time," the printing process control unit 30 outputs the test chart data 67 to the printer 13, and issues a test chart record command to the printer 13 (YES in step S6). The first time here is, for example, first inspection in product shipment of the printing system 10, first start-up of the printing system 10, or a first process of generating the density unevenness correction LUT 59 after replacement of the ink-jet head 11.

Upon receiving the command from the printing process control unit 30, the printer 13 performs the tone conversion processing, the density unevenness correction processing (step S7) based on the density unevenness correction LUT 59, the non-ejection correction processing (step S8), and the halftone processing on the test chart data 67 by the respective units 22 to 24 of the image processing circuit 19. Accordingly, the test chart data 67 is converted to the marking signal in the image processing circuit 19. The first density unevenness correction LUT 59 has a flat state as illustrated in FIGS. 6 and 7. The marking signal is output to the marking unit 20 from the image processing circuit 19. The density unevenness correcting test chart 57 is recorded on the recording medium 12 in the marking unit 20 (step S9). The density unevenness correcting test chart 57 is read by the in-line sensor 21, and the reading result data 57*a* is output to the density unevenness correction LUT generation unit 39 from the in-line sensor 21 (step S10).

The density unevenness correction LUT generation unit 39 analyzes the reading result data 57*a* input from the in-line sensor 21 to generate the new density unevenness correction LUT 59. The density unevenness correction LUT generation unit 39 stores the density unevenness correction LUT 59 in the data storage unit 28 (step S11, a storage step).

(Process of Updating the Density Unevenness Correction LUT)

Meanwhile, when the current process of generating the density unevenness correction LUT 59 is not performed for "first time," but the density unevenness correction LUT 59 already stored in the data storage unit 28 is updated (NO in step S6), the LUT preliminary modification unit 42 is operated under the command from the printing process control unit 30.

The defective nozzle information acquisition unit 42*a* of the LUT preliminary modification unit 42 acquires the current defective nozzle information 53 and the previous defective nozzle information 54 from the defective nozzle information storage unit 41 as indicated by the parenthesized number (4) in FIG. 11 (step S12, a defective recording element information acquisition step). The flattening processing unit 42*b* determines whether or not the new defective nozzle $\mathbf{11}_{NG}$ is detected after the previous update of the density unevenness correction LUT 59 by comparing the current defective nozzle information 53 and the previous defective nozzle information 54 (step S13). When the new defective nozzle $\mathbf{11}_{NG}$ is not detected, the flattening processing unit 42*b* is not operated, and the preliminary density unevenness correction LUT 65 is not generated. The process from step S7 to step S11 described above is thereby executed (NO in step S13).

To the contrary, when the new defective nozzle $\mathbf{11}_{NG}$ is detected after the previous update of the density unevenness correction LUT 59 (YES in step S13), the flattening processing unit 42*b* acquires the latest density unevenness correction LUT 59 from the data storage unit 28 as indicated by the parenthesized number (5) in FIG. 11 (step S14).

Subsequently, the flattening processing unit 42*b* calculates the average value AVG of the surrounding nozzle correction values corresponding to the surrounding nozzles 11A out of the respective correction values in the density unevenness correction LUT 59 as indicated by the parenthesized number (6) in FIG. 11 and as illustrated in FIG. 12. The flattening processing unit 42*b* performs on the density unevenness correction LUT 59 the flattening processing to suppress the amplitudes of the variations in the respective surrounding nozzle correction values, each of the amplitudes corresponding to a difference between the average value AVG and each of the surrounding nozzle correction values, and thereby generates the preliminary density unevenness correction LUT 65 (step S15 and step S16, a flattening processing step). The flattening processing unit 42*b* stores the preliminary density unevenness correction LUT 65 in the data storage unit 28.

After the preliminary density unevenness correction LUT 65 is stored in the data storage unit 28, the printing process control unit 30 outputs the test chart data 67 to the printer 13, and issues a test chart record command to the printer 13.

Upon receiving the command from the printing process control unit 30, the respective units 22 to 24 of the image processing circuit 19 of the printer 13 are operated. First, the tone conversion processing unit 22 of the image processing circuit 19 performs the tone conversion processing on the test chart data 67. Subsequently, the density unevenness correction processing unit 70 performs the density unevenness correction processing on the image signal of the test chart data 67 obtained after the tone conversion processing based on the preliminary density unevenness correction LUT 65 as indicated by the parenthesized number (8) in FIG. 13 (step S17, a first output correction step).

After the density unevenness correction processing, the non-ejection correction processing unit 71 reads out the current defective nozzle information 53 from the defective nozzle information storage unit 41, and also reads out the non-ejection correction LUT 45 from the data storage unit 28. The non-ejection correction processing unit 71 performs the non-ejection correction processing on the image signal obtained after the density unevenness correction processing based on the non-ejection correction LUT 45 after identifying the position of the defective nozzle $\mathbf{11}_{NG}$ based on the current defective nozzle information 53 as indicated by the parenthesized number (9) in FIG. 13 (step S8, a second output correction step).

Figure 16:
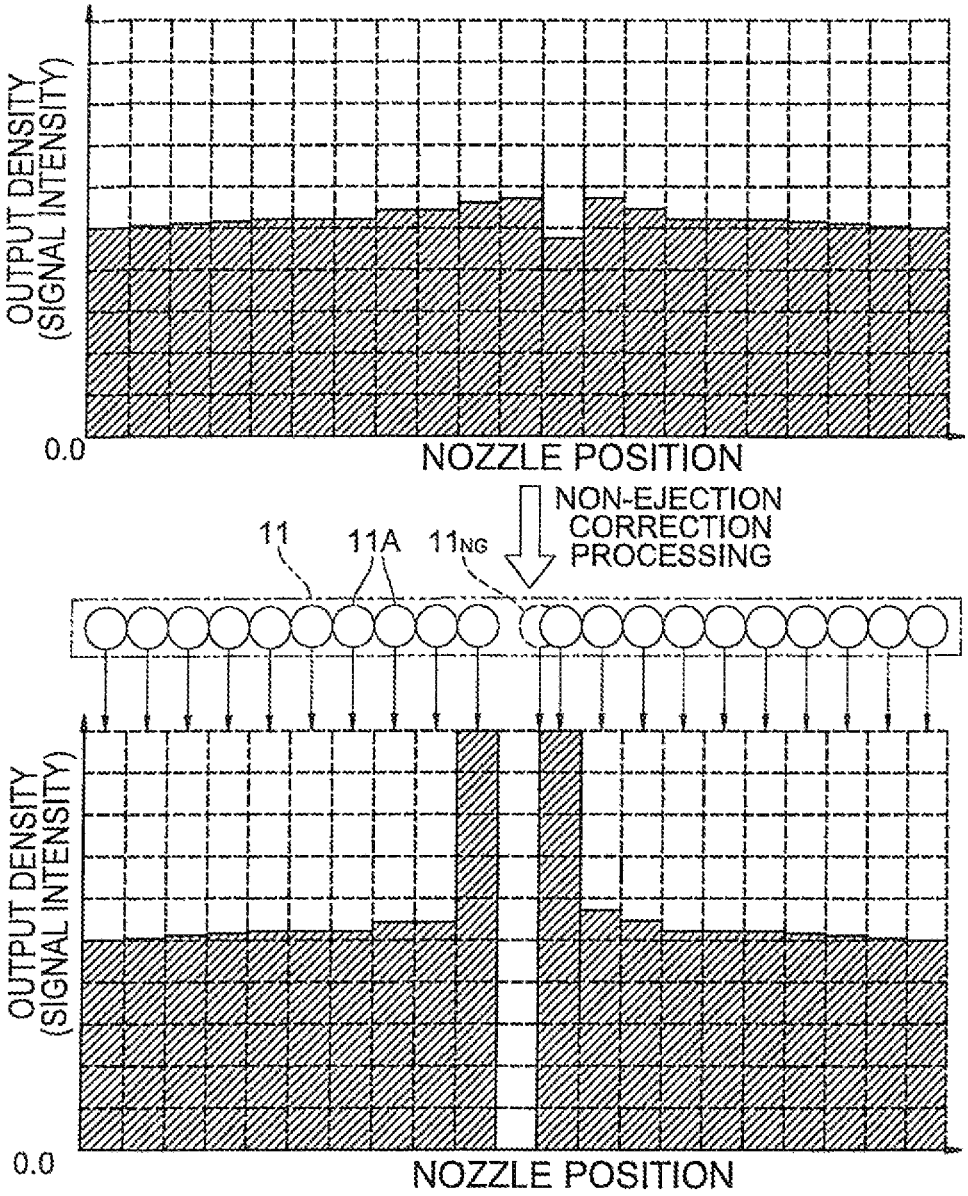
FIG. 16 is an explanatory view for explaining the output of the respective nozzles after the density unevenness correction and the non-ejection correction.

As illustrated in FIG. 16, the ink ejection from the defective nozzle $\mathbf{11}_{NG}$ is suspended, and the output densities of the adjacent nozzles 11A are increased by the non-ejection correction processing by the non-ejection correction processing unit 71. At this point, in the present embodiment, an increase in the output densities of the surrounding nozzles 11A (except for the adjacent nozzles 11A) due to the overlapping application of the density unevenness correction and the non-ejection correction is suppressed since the density unevenness correction based on the preliminary density unevenness correction LUT 65 is performed on the image signal. As a result, the occurrence of the overlapping overcorrection stripe unevenness 75 can be reduced, or even if the overlapping overcorrection stripe unevenness 75 occurs, the overlapping overcorrection stripe unevenness 75 can be made visually less noticeable.

Returning back to FIG. 15, the halftone processing unit 24 performs the halftone processing on the image signal obtained after the non-ejection correction processing to convert the image signal to the marking signal. The halftone processing unit 24 then outputs the marking signal to the marking unit 20. Accordingly, the density unevenness correcting test chart 57 is recorded on the recording medium 12 in the marking unit 20 as indicated by the parenthesized number (10) in FIG. 13 (step S9).

The printing process control unit 30 causes the in-line sensor 21 to start reading the density unevenness correcting test chart 57 at a timing at which the density unevenness correcting test chart 57 passes through the in-line sensor 21 along with conveyance of the recording medium 12. Accordingly, the density unevenness correcting test chart 57 is read by the in-line sensor 21 as indicated by the parenthesized number (11) in FIG. 13, and the reading result data 57*a* is output to the density unevenness correction LUT generation unit 39 (step S10, a property information acquisition step).

The density unevenness correction LUT generation unit 39 generates the new density unevenness correction LUT 59 by analyzing the reading result data 57*a* as indicated by the parenthesized number (12) in FIG. 13 and as illustrated in FIG. 5, and stores the density unevenness correction LUT 59 in the data storage unit 28 (step S11, an unevenness correcting information generation step). Accordingly, the density unevenness correction LUT 59 in the data storage unit 28 is updated by the density unevenness correction LUT generation unit 39 as indicated by the parenthesized number (13) in FIG. 13.

After updating the density unevenness correction LUT 59, the defective nozzle information storage unit 41 overwrites the preceding previous defective nozzle information 54 by employing the current defective nozzle information 53 as the new previous defective nozzle information 54 as indicated by the parenthesized number (14) in FIG. 13.

Returning to FIG. 14, the printing process control unit 30 controls the respective units of the PC 14 and the respective units of the printer 13 to repeat the process from step S1 to step S17 until receiving a print instruction in an operation unit (not illustrated) or the like (NO in step S19). Accordingly, the defective nozzle detecting process is repeated at the timing of the defective nozzle detecting process.

The respective processes illustrated in FIG. 15 are repeated at the timing of updating the density unevenness correction LUT 59, and the density unevenness correction LUT 59 in the data storage unit 28 is updated. By repeating the update of the density unevenness correction LUT 59, the density unevenness correction LUT 59 becomes closer to an appropriate value with which appropriate correction is enabled. At this point, in the present embodiment, by suppressing the increase in the output densities of the surrounding nozzles 11A due to the overlapping application of the density unevenness correction and the non-ejection correction, the density unevenness correction LUT 59 close to the appropriate value with which a recorded image in an appropriately-corrected state can be obtained is preliminarily generated. Therefore, the density unevenness correction LUT 59 can be brought close to the appropriate value with a smaller update number of times than the conventional cases.

(Image Recording Process: Printing Process)

When the print instruction is issued from the operation unit or the like (YES in step S19), the printing process control unit 30 outputs the image data 18 to the printer 13, and issues an image record command to the printer 13 (step S20).

The tone conversion processing unit 22 performs the tone conversion processing on the image data 18 upon receiving the command from the printing process control unit 30. Subsequently, the density unevenness correction processing unit 70 performs the density unevenness correction processing on the image signal of the image data 18 obtained after the tone conversion processing based on the updated density unevenness correction LUT 59 read out from the data storage unit 28 (step S21). The non-ejection correction processing unit 71 also performs the non-ejection correction processing on the image signal obtained after the density unevenness correction processing based on the latest defective nozzle information in the defective nozzle information storage unit 41 and the non-ejection correction LUT 45 (step S22).

The image signal of the image data 18 subjected to the non-ejection correction processing is subjected to the halftone processing in the halftone processing unit 24 to be converted to the marking signal, which is output to the marking unit 20. Accordingly, an image based on the image data 18 is recorded on the recording medium 12 in the marking unit 20 (step S23). Since the increase in the output densities of the surrounding nozzles 11A due to the overlapping application of the density unevenness correction and the non-ejection correction are suppressed as illustrated in FIG. 12, the occurrence of the overlapping overcorrection stripe unevenness 75 in the recorded image can be prevented.

When printing is performed again based on another image data 18 (YES in step S24), the respective processes described above are repeated. In the following, the processes of the respective steps are repeated until the printing in the printing system 10 is completed.

<Operation Effects of the Printing System>

As described above, in the present embodiment, the density unevenness correction LUT 59 is generated based on the density unevenness correcting test chart 57 to which the density unevenness correction is applied based on the preliminary density unevenness correction LUT 65. Accordingly, while the occurrence of the overlapping overcorrection stripe unevenness 75 can be prevented, the density unevenness correction LUT 59 can be brought close to the appropriate value with a small update number of times.

<Another Embodiment of the Flattening Processing>

(Linear Interpolation Processing)

Figure 17:
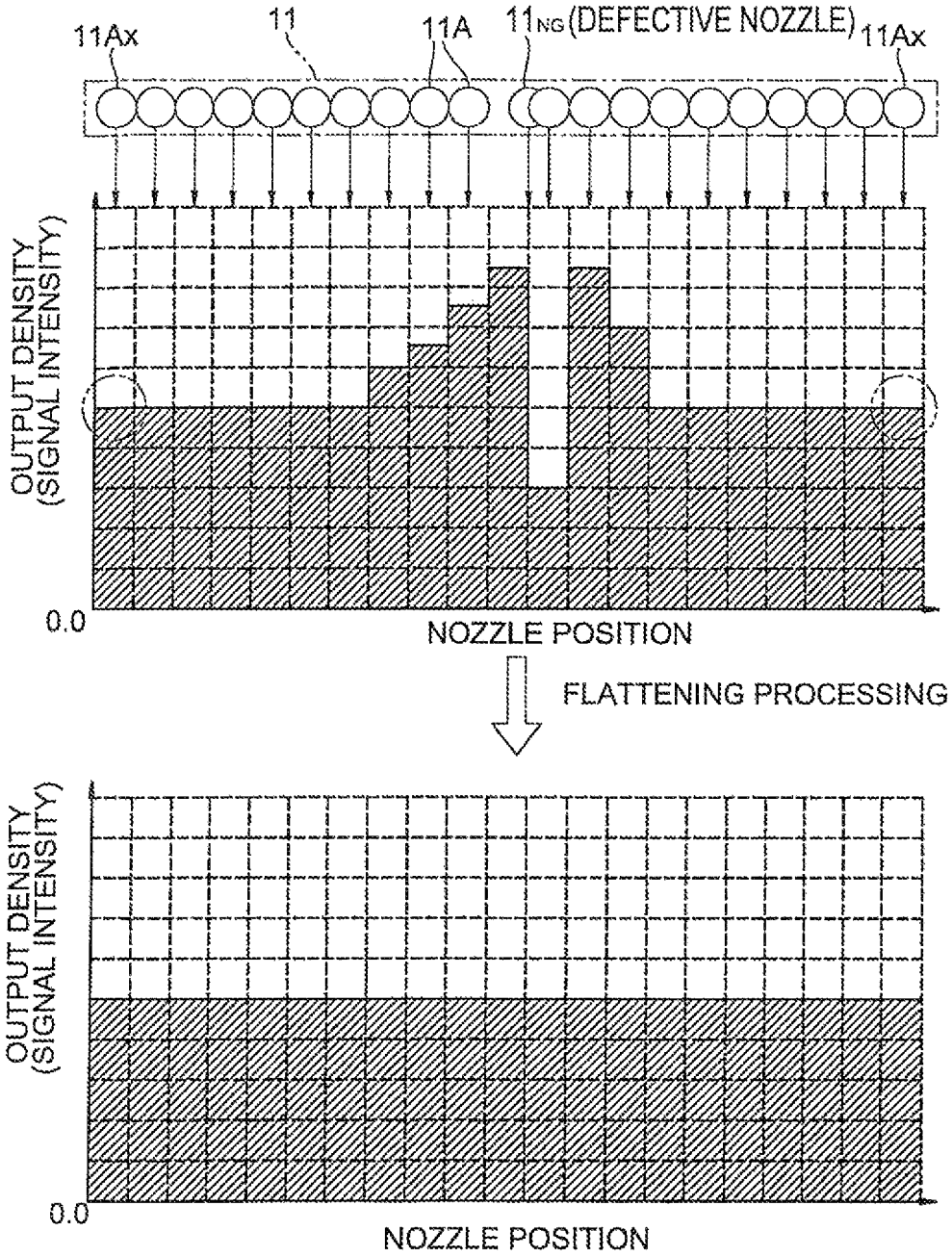
FIG. 17 is an explanatory view for explaining flattening processing according to another embodiment in which linear interpolation processing is performed.

Although the flattening processing unit 42*b* according to the above embodiment performs the flattening processing to suppress the amplitudes of the variations in the respective surrounding nozzle correction values as illustrated in FIG. 12, the presently disclosed subject matter is not limited thereto. For example, as illustrated in FIG. 17, the flattening processing unit 42*b* extracts surrounding nozzle correction values corresponding to surrounding nozzles 11Ax (referred to as a both-end surrounding nozzle 11Ax below) located at both ends of an arrangement direction (a right-left direction in the drawing) of the respective surrounding nozzles 11A out of the respective surrounding nozzles 11A from the correction values of the respective nozzles 11A in the latest density unevenness correction LUT 59.

Subsequently, the flattening processing unit 42*b* determines the surrounding nozzle correction values of the other surrounding nozzles 11A located between the both-end surrounding nozzles 11Ax by performing linear interpolation processing based on the surrounding nozzle correction values respectively corresponding to the both-end surrounding nozzles 11Ax. That is, the flattening processing unit 42*b* replaces the surrounding nozzle correction values of the other surrounding nozzles 11A with values obtained by the linear interpolation processing. The surrounding nozzle correction values of the other surrounding nozzles 11A are determined to be values dependent on the surrounding nozzle correction values of the both-end surrounding nozzles 11Ax. Thus, the variations in the respective surrounding nozzle correction values can be suppressed. As described above, the flattening processing unit 42*b* performs the flattening processing to suppress the variations in the respective surrounding nozzle correction values by determining the surrounding nozzle correction values of the other surrounding nozzles 11A by the linear interpolation processing based on the surrounding nozzle correction values of the both-end surrounding nozzles 11Ax.

(Smoothing Processing)

Figure 18:
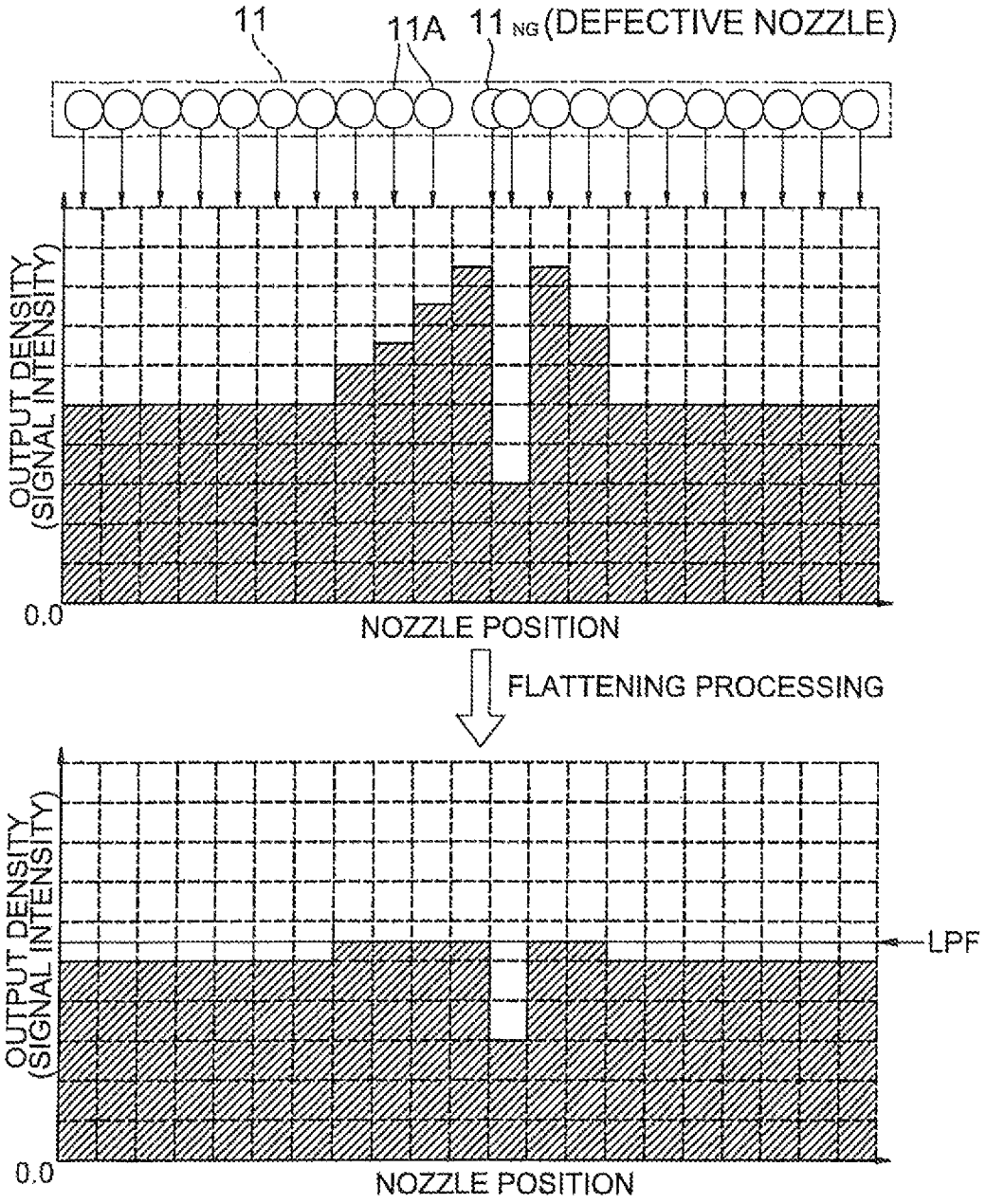
FIG. 18 is an explanatory view for explaining flattening processing according to another embodiment in which smoothing processing is performed.

As illustrated in FIG. 18, the flattening processing unit 42*b* may also suppress the variations in the respective surrounding nozzle correction values by performing smoothing processing using a low-pass filter LPF on the surrounding nozzle correction values of the respective surrounding nozzles 11A as the flattening processing. Instead of performing the smoothing processing using the low-pass filter LPF, the flattening processing unit 42*b* may also suppress the variations in the respective surrounding nozzle correction values by performing smoothing processing using a moving average. The method of the smoothing processing is not limited to those using the low-pass filter LPF and the moving average, and various known methods may be employed.

[Configuration Example of Another Ink-Jet Printer]

Next, a configuration example of a printer 100 as an example of the printer 13 illustrated in FIG. 1 is described.

Figure 19:
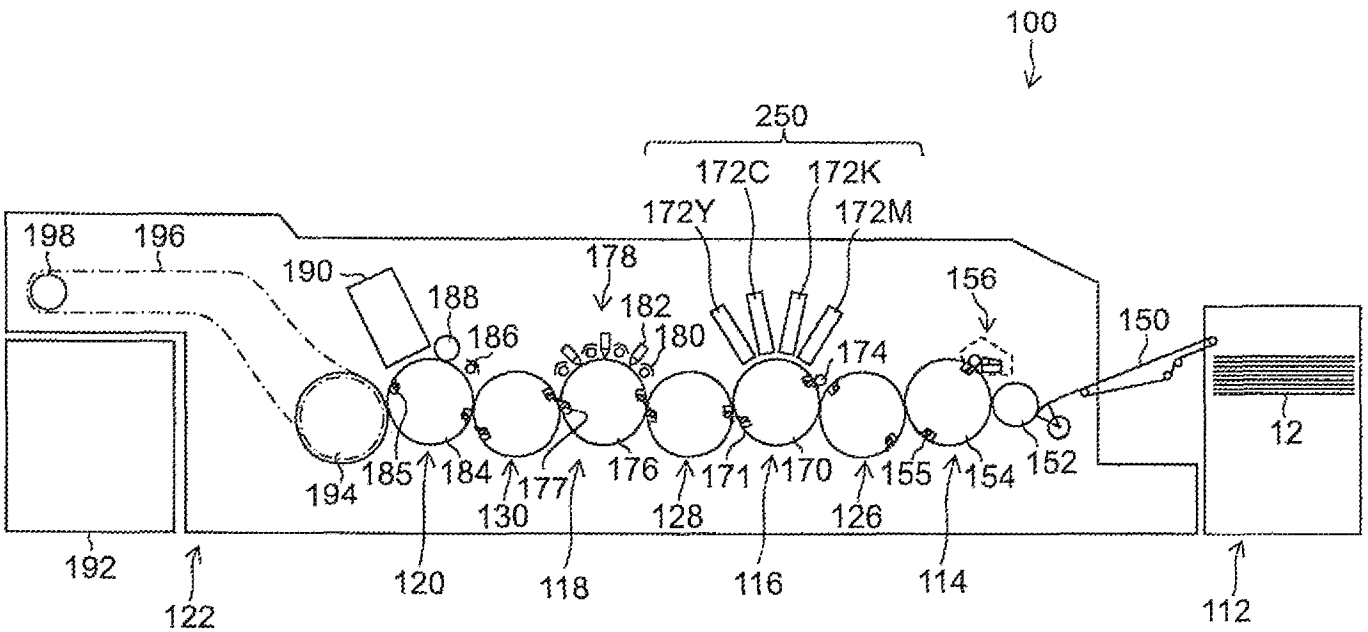
FIG. 19 is a schematic view of an ink-jet printer according to another example.

As illustrated in FIG. 19, the printer 100 is an ink-jet printer employing a direct image formation method, which forms a desired color image by depositing ink of a plurality of colors on the recording medium 12 held on a drawing drum 170 from an ink-jet head 250 (composed of ink-jet heads 172M, 172K, 172C, and 172Y for the colors of CMYK), and is an ink-jet printer employing a two-liquid reaction (aggregation) method in which an image is formed on the recording medium 12 by applying a treatment liquid (here, an aggregating treatment liquid) onto the recording medium 12 before deposition of the ink, and causing a reaction between the treatment liquid and the ink liquid.

The printer 100 mainly includes a paper feed unit 112, a treatment liquid application unit 114, a recording unit 116, a drying unit 118, a fixing unit 120, and a paper discharge unit 122.

(Paper Feed Unit)

The recording media 12 as sheets of paper are stacked in the paper feed unit 112. The recording media 12 are fed to the treatment liquid application unit 114 one by one from a paper feed tray 150 of the paper feed unit 112. Although the sheets of paper (cut sheets of paper) are used as the recording medium 12, a configuration in which paper is fed by cutting a continuous roll of paper (rolled paper) into a necessary size may also be employed.

(Treatment Liquid Application Unit)

The treatment liquid application unit 114 is a mechanism which applies the treatment liquid to the surface of the recording medium 12. The treatment liquid contains a coloring material aggregating agent which aggregates a coloring material (a pigment in the present embodiment) in the ink applied by the recording unit 116. When the treatment liquid and the ink come into contact with each other, the coloring material and a solvent in the ink are prompted to be separated.

The treatment liquid application unit 114 includes a paper feed cylinder 152, a treatment liquid drum 154, and a treatment liquid application device 156. The treatment liquid drum 154 includes a hook-like holding device (a gripper) 155 on an outer peripheral surface thereof. By sandwiching the recording medium 12 between the hook of the holding device 155 and the peripheral surface of the treatment liquid drum 154, a distal end of the recording medium 12 can be held. A suction hole may be provided in the outer peripheral surface of the treatment liquid drum 154, and a suction device which performs suction from the suction hole may be connected thereto. Accordingly, the recording medium 12 can be adhesively held on the peripheral surface of the treatment liquid drum 154.

The treatment liquid application device 156 is arranged facing the peripheral surface of the treatment liquid drum 154. The treatment liquid application device 156 includes a treatment liquid vessel in which the treatment liquid is stored, an anilox roller which is partially immersed in the treatment liquid in the treatment liquid vessel, and a rubber roller which is in pressure contact with the anilox roller and the recording medium 12 on the treatment liquid drum 154 to move a dosed amount of treatment liquid onto the recording medium 12. The treatment liquid application device 156 can apply the treatment liquid to the surface of the recording medium 12 while dosing the amount of treatment liquid. Although an application method using the roller is described as an example in the present embodiment, the presently disclosed subject matter is not limited thereto. For example, various methods such as spray method and ink-jet method may be employed.

The recording medium 12 to which the application liquid has been applied is transferred to the drawing drum 170 of the recording unit 116 via an intermediate conveyance unit 126 from the treatment liquid drum 154.

(Recording Unit)

The recording unit 116 includes the drawing drum 170, a paper pressing roller 174, and an ink-jet head 250 (ink-jet heads 172M, 172K, 172C, and 172Y). The drawing drum 170 includes a hook-like holding device (a gripper) 171 on an outer peripheral surface thereof similarly to the treatment liquid drum 154.

The ink-jet heads 172M, 172K, 172C, and 172Y are ink-jet heads of full-line ink-jet-type having a length corresponding to the maximum width of an image formation region of the recording medium 12. A nozzle line in which a plurality of ink-ejecting nozzles are arranged over the entire width of the image formation region is formed on each of the nozzle ejection surfaces. The respective ink-jet heads 172M, 172K, 172C, and 172Y are arranged so as to extend in a direction (a first direction) perpendicular to the conveyance direction of the recording medium 12 (a rotating direction of the drawing drum 170, a second direction).

When the respective ink-jet heads 172M, 172K, 172C, and 172Y of the ink-jet head 250 arranged on the surface side of the recording medium 12 eject droplets of the corresponding colored ink toward the surface of the recording medium 12 adhesively held on the drawing drum 170, the treatment liquid applied to the recording surface in advance in the treatment liquid application unit 114 and the ink come into contact with each other. The coloring material (the pigment) dispersed in the ink is thereby aggregated to form a coloring material aggregate. Accordingly, movement of the coloring material on the recording medium 12 or the like is prevented. An image is formed on the surface of the recording medium 12.

That is, the image can be recorded on the image formation region on the surface of the recording medium 12 by performing only once an operation of conveying the recording medium 12 by the drawing drum 170 at constant speed, and relatively moving the recording medium 12 and the respective ink-jet heads 172M, 172K, 172C, and 172Y with respect to the conveyance direction (that is, only one sub-scanning operation).

The recording medium 12 on which the image has been formed is transferred to a drying drum 176 of the drying unit 118 via an intermediate conveyance unit 128 from the drawing drum 170.

(Drying Unit)

The drying unit 118 is a mechanism which dries water contained in the solvent separated by the coloring material aggregating action. The drying unit 118 includes the drying drum 176, and a solvent drying device 178. The drying drum 176 includes a hook-like holding device (a gripper) 177 on an outer peripheral surface thereof similarly to the treatment liquid drum 154. The distal end of the recording medium 12 can be held by the holding device 177.

The solvent drying device 178 is arranged at a position facing the outer peripheral surface of the drying drum 176.

The solvent drying device 178 includes a plurality of halogen heaters 180, and a hot air spraying nozzle 182 arranged between the respective halogen heaters 180. The recording medium 12 subjected to dry processing in the drying unit 118 is transferred to a fixing drum 184 of the fixing unit 120 via an intermediate conveyance unit 130 of the drying drum 176.

(Fixing Unit)

The fixing unit 120 includes the fixing drum 184, a halogen heater 186, a fixing roller 188, and an in-line sensor 190. The fixing drum 184 includes a hook-like holding device (a gripper) 185 on an outer peripheral surface thereof similarly to the treatment liquid drum 154. The distal end of the recording medium 12 can be held by the holding device 185.

When the fixing drum 184 is rotated, preliminary heating by the halogen heater 186, fixing by the fixing roller 188, and inspection by the in-line sensor 190 are performed on the recording surfaces (both surfaces) of the recording medium 12.

The fixing roller 188 is a roller member which melts and fixes self-dispersible polymer fine particles in the ink by heating and pressurizing the dried ink, and thereby forms the ink into a film. The fixing roller 188 is configured to heat and pressurize the recording medium 12. To be more specific, the fixing roller 188 is arranged so as to be in pressure contact with the fixing drum 184, and constitutes a nip roller with the fixing drum 184. Accordingly, the recording medium 12 is sandwiched between the fixing roller 188 and the fixing drum 184, nipped under a predetermined nip pressure, and thereby subjected to the fixing process.

The fixing roller 188 is composed of a heating roller in which a halogen lamp or the like is incorporated. The fixing roller 188 is controlled at a predetermined temperature.

The in-line sensor 190 is a device which reads the image formed on the recording medium 12 to detect the density of the image, a flaw in the image, or the like. A CCD line sensor or the like is employed. The in-line sensor 190 is basically the same as the above in-line sensor 21.

In the fixing unit 120, latex particles in a thin image layer formed by the drying unit 118 are heated, pressurized, and melted by the fixing roller 188, so that the image layer can be fixed to the recording medium 12. The surface temperature of the fixing drum 184 is set to 50° C. or more.

Ink containing a monomer component which can be polymerized and cured by exposure to UV light may be employed instead of the ink containing a high-boiling solvent and polymer fine particles (thermoplastic resin particles). In this case, the printer 100 includes a UV exposure unit which exposes the ink on the recording medium 12 to UV light instead of the heat-pressure fixing unit (the fixing roller 188) using the heat roller. When the ink containing active light-curable resin such as the UV-curable resin is used, a device which emits active light, such as a UV lamp and an ultraviolet LD (laser diode) array, is provided instead of the heat fixing roller 188.

(Paper Discharge Unit)

The paper discharge unit 122 is provided subsequent to the fixing unit 120. The paper discharge unit 122 includes a discharge tray 192. A transfer cylinder 194, a conveyance belt 196, and a tension roller 198 are provided between the discharge tray 192 and the fixing drum 184 of the fixing unit 120 so as to face the discharge tray 192 and the fixing drum 184 of the fixing unit 120. The recording medium 12 is sent to the conveyance belt 196 by the transfer cylinder 194, and discharged to the discharge tray 192. Although a paper conveying mechanism using the conveyance belt 196 is not illustrated in detail, a paper distal end portion of the recording medium 12 after printing is held by a gripper of a bar (not illustrated) suspended between the endless conveyance belts 196, and the recording medium 12 is conveyed to above the discharge tray 192 by the rotation of the conveyance belt 196.

Although not illustrated in the drawings, the printer 100 in the present embodiment includes an ink storage/loading unit which supplies ink to the respective ink jet heads 172M, 172K, 172C, and 172Y, a device which supplies the treatment liquid to the treatment liquid application unit 114, a head maintenance unit which cleans (wiping of the nozzle surface, purging, nozzle suction or the like) the respective ink-jet heads 172M, 172K, 172C, and 172Y, a position detection sensor which detects the position of the recording medium 12 in the paper conveyance path, and a temperature sensor which detects the temperature of the respective units of the apparatus in addition to the above configuration.

[Structure of the Ink-Jet Head]

Next, the structure of the ink-jet heads 172M, 172K, 172C and 172Y provided on the recording unit 116 is described. Since the ink-jet heads 172M, 172K, 172C and 172Y corresponding to the respective colors have a common structure, these heads are represented by the ink-jet head 250 in the following description.

Figure 20:
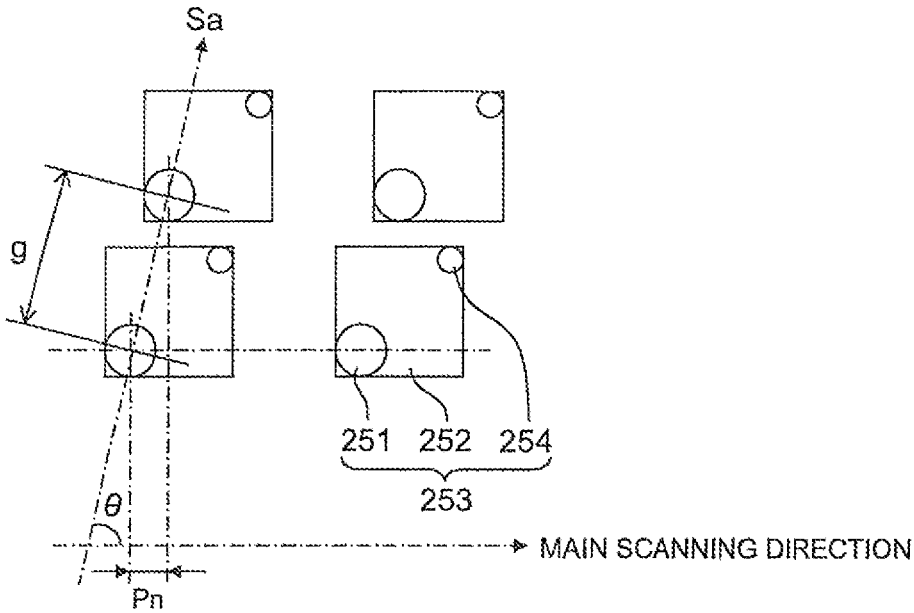
FIG. 20 is a schematic view illustrating a configuration example of an ink-jet head.

As illustrated in FIG. 20, the ink-jet head 250 has a structure in which a plurality of ink chamber units (droplet ejection elements as a unit of the recording element) 253 each including a nozzle 251 as an ink ejection port, and a pressure chamber 252 in communication with each nozzle 251, and a supply port 254 that brings a common flow channel (not illustrated) and each pressure chamber 252 into communication are arranged in matrix. Accordingly, a high density is achieved in an effective nozzle pitch (a projected nozzle pitch in the drawing designated by reference character Pn) obtained by projecting the nozzles to be aligned in a main scanning direction as a longitudinal direction of the ink-jet head 250.

Each pressure chamber 252 in communication with the nozzle 251 has a substantially square planar shape. The nozzle 251 is arranged in one of two corner portions on a diagonal line, and the supply port 254 is arranged in the other. The shape of the pressure chamber 252 is not limited to that of the present embodiment and various modes in which the planar shape is a quadrangular shape (rhombic shape, rectangular shape, or the like), a pentagonal shape, a hexagonal shape, or other polygonal shapes, a circular shape, an elliptical shape, or the like may be employed.

The high-density nozzle head of the present embodiment is achieved by arranging the ink chamber units 253 each including the nozzle 251, the pressure chamber 252 and the like in matrix according to a given arrangement pattern in a row direction along the main scanning direction (designated by reference character M) and an oblique column direction (designated by reference character Sa) having a given non-perpendicular angle $\theta$ ($0° < \theta < 90°$ with respect to the main scanning direction.

That is, according to the structure in which the plurality of ink chamber units 253 are arranged at a uniform pitch g in the direction having a given angle $\theta$ with respect to the main scanning direction, the projected nozzle pitch Pn obtained by projecting the nozzles to be arranged in the main scanning direction is $g \times \cos\theta$. As for the main scanning direction, the arrangement can be treated as equivalent to a configuration where the respective nozzles 251 are arranged linearly at a uniform pitch of Pn. In accordance with the configuration, high-density arrangement in which a nozzle column obtained by projecting the nozzles to be arranged in the main scanning direction has as much as 1,200 nozzles per inch (1,200 nozzle/inch) can be achieved.

Figure 21:
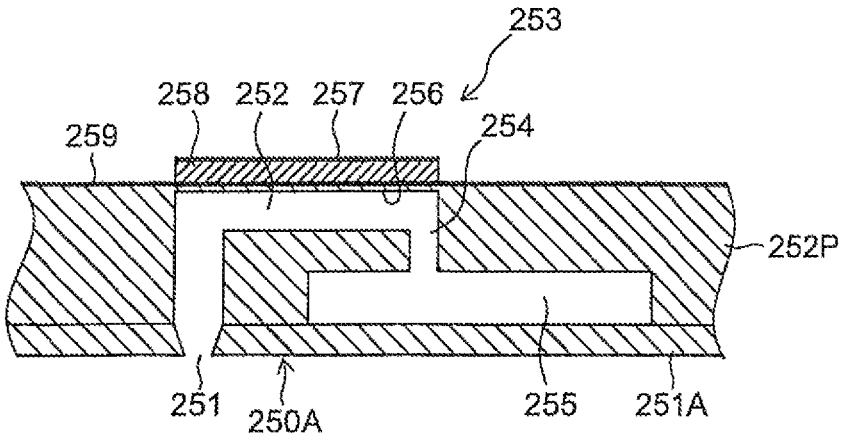
FIG. 21 is a sectional view of the ink-jet head.

As illustrated in FIG. 21, the ink-jet head 250 has a structure in which a nozzle plate 251A in which the nozzles 251 are formed, a flow channel plate 252P in which flow channels such as the pressure chambers 252 and a common flow channel 255 are formed, and so on, are layered and bonded together.

The flow channel plate 252P is a flow channel forming member which constitutes side wall portions of the pressure chambers 252 and in which the supply port 254 is formed to serve as a restricting portion (most constricted portion) of an individual supply channel for guiding ink to the pressure chamber 252 from the common flow channel 255. Although a simplified view is given in FIG. 21 for the convenience of description, the flow channel plate 252P has a structure formed by layering one or a plurality of substrates together.

The nozzle plate 251A and the flow channel plate 252P can be processed into a desired shape by a semiconductor manufacturing process using silicon as a material.

The common flow channel 255 communicates with an ink tank (not illustrated) as an ink supply source. The ink supplied from the ink tank is supplied through the common flow channel 255 to the respective pressure chambers 252.

A piezoelectric actuator 258 including an individual electrode 257 is bonded to a vibration plate 256 that constitutes a portion of the surface of the pressure chamber 252 (the ceiling in FIG. 21). The vibration plate 256 in the present embodiment is made of silicon (Si) having a nickel (Ni) conducting layer, which functions as a common electrode 259 corresponding to a lower electrode of the piezoelectric actuator 258, and serves as a common electrode for the piezoelectric actuator 258 which is arranged corresponding to each of the pressure chambers 252. A mode in which the vibration plate is made from a non-conductive material such as resin may also be employed. In this case, a common electrode layer made of a conductive material such as metal is formed on the surface of the vibration plate member. Furthermore, the vibration plate which also serves as the common electrode can be made of metal (conductive material) such as stainless steel (SUS).

When a drive voltage is applied to the individual electrode 257, the piezoelectric actuator 258 deforms, thereby changing the volume of the pressure chamber 252. A pressure change is thereby caused, so that the ink is ejected from the nozzle 251. When the piezoelectric actuator 258 returns to its original position after the ink ejection, the pressure chamber 252 is filled again with new ink from the common flow channel 255 through the supply port 254.

Although the printer 100 to which a pressure-cylinder conveyance method is applied is described in the present embodiment, the conveyance method of the recording medium 12 is not limited to the pressure-cylinder conveyance method. A belt conveyance method in which the recording medium 12 is conveyed while being adhesively held on a conveyance belt, or another conveyance method may also be employed.

The mode of arrangement of the nozzles 251 is not limited to the embodiment illustrated in the drawings, and it is possible to adopt various nozzle arrangement structures. For example, it is possible to use a single line linear nozzle arrangement, a V-shaped nozzle arrangement, or a broken line nozzle arrangement such as a zig-zag shape (W shape, or the like) in which a V-shaped nozzle arrangement is repeated.

[Others]

In the above embodiments, the density unevenness correction LUT 59 is described as an example of the unevenness correcting information in the presently disclosed subject matter. However, various unevenness correcting information such as an arithmetic expression indicating the correction value of the output density of each nozzle 11A for correcting density unevenness may also be used.

Although the storage of the density unevenness correction LUT 59 and the LUT preliminary modification unit 42 are performed in the PC 14 in the aforementioned embodiments, at least one of them may be performed in the printer 13. The presently disclosed subject matter may also be applied to an image recording apparatus in which the printer 13 and the PC 14 are integrally formed.

Although the respective test charts 44, 49, and 57 are separately created in the aforementioned embodiments, the respective test charts 44, 49, and 57 may be collectively recorded on a single recording medium 12. The respective test charts 44, 49, and 57 may also be respectively recorded on a margin portion of the recording medium 12.

Although the flattening processing is not performed when the process of generating the density unevenness correction LUT 59 is performed for "first time" (YES in step S4 in FIG. 15) in the aforementioned embodiments, the flattening processing may also be performed. The correction values in the density unevenness correction LUT 59 generally have a flat state (see FIG. 6) in an initial setting state. However, when the correction values are not flat in the initial setting state, the flattening processing is preferably performed. Although the flattening processing is also performed on the correction value corresponding to the defective nozzle $\mathbf{11}_{NG}$ in the aforementioned embodiments, the correction value corresponding to the defective nozzle $\mathbf{11}_{NG}$ may be excluded from the object of the flattening processing.

Although the recording head according to the above embodiments records the four colors of CMYK, the recorded color is not particularly limited. The presently disclosed subject matter may also be applied to an ink-jet printer including a recording head of, for example, shuttle head type which moves a recording head with respect to a recording paper instead of moving the recording paper with respect to the fixed recording head.

In the aforementioned respective embodiments, the description is made based on the example in which the presently disclosed subject matter is applied to an ink-jet printer for graphic printing. However, the applicable range of the presently disclosed subject matter is not limited to the example. For example, the presently disclosed subject matter can be widely applied to an ink-jet printer which draws various shapes or patterns by using a liquid functional material, such as a wiring drawing apparatus which draws a wiring pattern of an electronic circuit, various device production apparatuses, a resist printing apparatus which uses a resin liquid as a functional liquid for ejection, a color filter production apparatus, and a fine structure forming apparatus which forms a fine structure by using a material for material deposition.

Although the ink-jet printer is described as an example of the image recording apparatus of the presently disclosed subject matter in the aforementioned respective embodiments, the presently disclosed subject matter can be applied to various image recording apparatuses such as a thermal transfer recording apparatus including a plurality of recording heads where a thermal element serves as a recording element, and an LED electrophotographic printer including a plurality of recording heads where an LED element serves as a recording element.

The presently disclosed subject matter can be provided as a computer-readable program code for causing a device to execute the above described process, a non-transitory computer-readable recording medium on which the computer-readable program code is stored or a computer program product storing executable code for the method.

What is claimed is:

1. An image recording apparatus comprising:

a recording control unit configured to record an image on a recording medium by a recording head having a plurality of recording elements while relatively moving the recording head and the recording medium;

a first storage unit configured to preliminarily store unevenness correcting information for correcting unevenness in the image, the unevenness correcting information indicating a correction value of an output for each of the recording elements;

a defective recording element detection unit configured to detect a defective recording element out of the recording elements and store defective recording element information indicating the defective recording element in a second storage unit;

a defective recording element information acquisition unit configured to acquire defective recording element information at a previous timing of updating the unevenness correcting information and latest defective recording element information from the second storage unit when a timing of updating the unevenness correcting information arrives;

a flattening processing unit configured to compare the previous defective recording element information and the latest defective recording element information acquired by the defective recording element information acquisition unit, the flattening processing unit configured to perform, when a new defective recording element is detected in the latest defective recording element information, a flattening processing to suppress variations in correction values corresponding to a plurality of surrounding recording elements located around the defective recording element on the unevenness correcting information read out from the first storage unit;

a first output correction unit configured to perform a correction of outputs of the respective recording elements based on the unevenness correcting information obtained after the flattening processing when the flattening processing is performed by the flattening processing unit;

a second output correction unit configured to suspend an output of the defective recording element and increase an output of a recording element at least adjacent to the defective recording element after the correction by the first output correction unit;

a property information acquisition unit configured to acquire property information indicating a recording property of each of the recording elements, the outputs of which are corrected by the first output correction unit and second output correction unit; and an unevenness correcting information generation unit configured to generate new unevenness correcting information corresponding to the property information acquired by the property information acquisition unit, and update the unevenness correcting information in the first storage unit.

2. The image recording apparatus according to claim 1, wherein the flattening processing unit performs a processing to suppress an amplitude of the variation in the correction value corresponding to each of the surrounding recording elements as the flattening processing.

3. The image recording apparatus according to claim 1, wherein based on correction values corresponding to surrounding recording elements located at both ends of an arrangement direction of the recording elements out of the surrounding recording elements, the flattening processing unit performs a processing to determine correction value corresponding to another surrounding recording element by linear interpolation processing as the flattening processing.

4. The image recording apparatus according to claim 1, wherein the flattening processing unit performs a smoothing processing on the correction values corresponding to the respective surrounding recording elements as the flattening processing.

5. The image recording apparatus according to claim 1, wherein the surrounding recording elements are recording elements located in an area wider than an area of the recording element, the output of which is increased by the second output correction unit.

6. The image recording apparatus according to claim 1, further comprising a repetition control unit configured to repeatedly operate the flattening processing unit, the first output correction unit, the second output correction unit, the property information acquisition unit, and the unevenness correcting information generation unit every time the timing of updating the unevenness correcting information arrives.

7. The image recording apparatus according to claim 1, wherein the property information acquisition unit reads a test chart recorded on the recording medium by the recording elements, the outputs of which are corrected by the first output correction unit and the second output correction unit, and indicating a recording density of each of the recording elements, and acquires a reading result of the test chart as the property information.

8. The image recording apparatus according to claim 1, wherein when the flattening processing unit is not operated, the first output correction unit corrects the outputs of the recording elements based on the unevenness correcting information in the first storage unit.

9. The image recording apparatus according to claim 1, wherein the recording head is an ink-jet head.

10. A method for controlling an image recording apparatus, the method comprising:

a storage step of preliminarily storing, in a first storage unit, unevenness correcting information indicating a correction value of an output for each of a plurality of recording elements of a recording head for correcting unevenness in an image recorded on a recording medium by the recording head;

a defective recording element detection step of detecting a defective recording element out of the recording elements and storing defective recording element information indicating the defective recording element in a second storage unit;

a defective recording element information acquisition step of acquiring defective recording element information at a previous timing of updating the unevenness correcting information and latest defective recording element information from the second storage unit when a timing of updating the unevenness correcting information arrives;

a flattening processing step of comparing the previous defective recording element information and the latest defective recording element information acquired in the defective recording element information acquisition step, and when a new defective recording element is detected in the latest defective recording element information, performing a flattening processing to suppress variations in correction values corresponding to a plurality of surrounding recording elements located around the defective recording element on the unevenness correcting information read out from the first storage unit;

a first output correction step of performing a correction of outputs of the recording elements based on the unevenness correcting information subjected to the flattening processing in the flattening processing step;

a second output correction step of suspending an output of the defective recording element and increasing an output of another recording element at least adjacent to the defective recording element after the correction in the first output correction step;

a property information acquisition step of acquiring property information indicating a recording property of each of the recording elements, the outputs of which are corrected in the first output correction step and the second output correction step; and an unevenness correcting information generation step of generating new unevenness correcting information corresponding to the property information acquired in the property information acquisition step, and updating the unevenness correcting information in the first storage unit.

11. A non-transitory computer-readable recording medium including instructions stored thereon, such that when the instructions are read and executed by a processor, the processor is configured to perform:

a storage step of preliminarily storing, in a first storage unit, unevenness correcting information indicating a correction value of an output for each of a plurality of recording elements of a recording head for correcting unevenness in an image recorded on a recording medium by the recording head;

a defective recording element detection step of detecting a defective recording element out of the recording elements and storing defective recording element information indicating the defective recording element in a second storage unit;

a defective recording element information acquisition step of acquiring defective recording element information at a previous timing of updating the unevenness correcting information and latest defective recording element information from the second storage unit when a timing of updating the unevenness correcting information arrives;

a flattening processing step of comparing the previous defective recording element information and the latest defective recording element information acquired in the defective recording element information acquisition step, and when a new defective recording element is detected in the latest defective recording element information, performing a flattening processing to suppress variations in correction values corresponding to a plurality of surrounding recording elements located around the defective recording element on the unevenness correcting information read out from the first storage unit;

a first output correction step of performing a correction of outputs of the recording elements based on the unevenness correcting information subjected to the flattening processing in the flattening processing step;

a second output correction step of suspending an output of the defective recording element and increasing an output of another recording element at least adjacent to the defective recording element after the correction in the first output correction step;

a property information acquisition step of acquiring property information indicating a recording property of each of the recording elements, the outputs of which are corrected in the first output correction step and the second output correction step; and an unevenness correcting information generation step of generating new unevenness correcting information corresponding to the property information acquired in the property information acquisition step, and updating the unevenness correcting information in the first storage unit.

* * * * *